United States Patent [19]

Kubacki et al.

[11] 3,967,482

[45] July 6, 1976

[54] PRODUCTION OF CLOSED BOTTOM SHELLS

[75] Inventors: Edward F. Kubacki, Arlington Heights; Bengt S. Backe, Dundee; Vance B. Gold, Lombard; Harold J. Jessogne, Arlington Heights; Frederick G. Kudert, Chicago; Harold C. Lemke, Grayslake; William D. Timmins, Elgin, all of Ill.

[73] Assignee: American Can Company, Greenwich, Conn.

[22] Filed: Mar. 17, 1975

[21] Appl. No.: 559,400

[52] U.S. Cl. ..... 72/7; 72/21; 72/345; 72/349

[51] Int. Cl.[2] ..... B21D 22/28

[58] Field of Search ..... 72/344, 345, 347, 348, 72/349, 7, 21

[56] References Cited

UNITED STATES PATENTS

| | | | |
|---|---|---|---|
| 398,229 | 2/1889 | Chambers | 72/345 |
| 435,078 | 8/1890 | Riley | 72/347 |
| 3,167,044 | 1/1965 | Hendrickson | 72/349 |
| 3,289,453 | 12/1966 | Wyle et al. | 72/349 |
| 3,402,591 | 9/1968 | Maeder | 72/345 |
| 3,457,766 | 7/1969 | Langewis et al. | 72/347 |
| 3,599,470 | 8/1971 | Smith et al. | 72/349 |

*Primary Examiner*—Lowell A. Larson
*Attorney, Agent, or Firm*—Robert P. Auber; Ira S. Dorman; James B. Kinzer

[57] ABSTRACT

Elongated closed bottom shells (cans) are produced in the preferred manner by a double-acting punch body arranged on a horizontal axis and reciprocated between opposed die stations at a substantially constant velocity by a hydraulic force alternately applied to opposite sides of a ram on the punch body; blanks (of cup form) are fed to the die stations at times when the punch body dwells at the end of a stroke. Preferably the applied force is such that punch body attains peak (maximum) velocity before the punch encounters a cup centered at the die station; cup feed, cup positioning, punch body travel and formation of a shell of correct length are monitored (sensed) and in the event a programmed condition of machine function or production criterion is sensed as not satisfied, the machine is stopped.

During the return stroke of the punch body, after a shell is formed at one station, fluid under pressure is applied by a unique porting arrangement to a separable part of the punch, which thereby serves as a stripper to hold the completed shell stationary at the die station while the remainder of the punch body is retracted from the shell; concurrently, air under pressure is ported in a unique fashion to break any vacuum inside of the shell. After the shell is stripped, the stripper is retracted at an accelerated rate to re-couple with the punch body as it moves toward the other die station.

The main cylinder is so supported that thermal effects will not disturb the alignment of the punch body relative to the dies.

96 Claims, 26 Drawing Figures

75
95
194
94
61
86
85
72
94T
62
63
6

60
87
90
81
86
85
62
88

63
81
62
92
60

100
61
61B
35
109
153
110
108
112
122
157
134
155
131
132
154
123
133
166
125
121
167
151
165
152
57
150
56
130
135
170
172
173
171
138
175
139
176
136
33
149
148
178
33C
33A
25
26
26C 42-3
55
161
105
159
106
161
153
113
110
X
157
112
155
154
152
152
26
131
131
130
133
149
135
130
X

PRODUCTION OF CLOSED BOTTOM SHELLS

This invention relates to a machine for producing can shells and more particularly to one having a reciprocal double-ended punch effective to draw and iron a cup during each opposed stroke, resulting in shells that are further processed incidental to completing finished cans ready to be filled.

Cans are currently produced with exceedingly thin walls, down to 0.004 inch and even less, obtained by first drawing the wall of a cup to produce a wall of intermediate length and then ironing the wall to make it taller.

The free edge of the ironed shell is not uniform but is somewhat eared or wavy. This ragged edge is trimmed to a smooth edge. Other operations are performed before the free end is finally necked down somewhat and then flanged, ready to be filled and capped.

Can shells thus obtained by drawing and ironing may be of aluminum, steel or tin coated steel. Both drawing and ironing are accomplished by using a punch to force the cup through a drawing die (one or more) and a series of ironing dies at a shell forming station which may also be termed herein the die station. Inasmuch as the contents ultimately placed in the can may be under considerable pressure, the bottom of the shell is preferably made concave at the termination of ironing to strengthen the bottom. The so-called dome is obtained at the end of the punch stroke by forcing the bottom of the shell against suitable tooling of the shell forming station.

As can be imagined, the ironed shell can be quite tight on the punch, especially since an undercut portion of the die is presented to the top of the completed shell. Consequently a considerable problem of efficient stripping is involved. It is not acceptable to strip the shell by any device engaging the external surface because the side wall is so thin it will buckle. An internal stripper which literally pushes the shell off the punch by a force applied to the shell internally must therefore be used. It is not new to use fluid under pressure to strip a can shell or operate an internal stripper independently of the punch, but this is generally accomplished by relying on hoses or jointed tubes or sliding tubes affording connections for operating fluid in combination with an external control to time application of fluid under pressure. The known arrangements are not durable and are not easily controlled in a precision manner.

Therefore, an object of the present invention is to operate and control an internal stripper with greater latitude than heretofore and to reduce the possibility of connection failures which supply operating fluid under pressure by relying on a fixed point of punch travel to expose the stripper to a reservoir of operating fluid, conditioning the stripper for operation. More specifically in this regard it is an object of the present invention to provide in an enlarged bushing, necessary to guide and support the punch, a reservoir for fluid which is pressurized and enters a port in the punch body (the punch body is a tube) after the punch has finally attained its fully advanced position. The entering fluid pressurizes a chamber inside the punch body in which is located a piston on the stripper, thereby conditioning the stripper for extension relative to the punch body after the shell is formed. In this manner, no other connections or hoses or couplings are required in order to supply operating fluid to the stripper from the bushing reservoir. Therefore, forceful delivery of stripper fluid only requires the bushing reservoir to be pressurized at the proper point of punch travel.

Attainment of the object just mentioned is important. If fluid under pressure is not communicated (a failed connection) or if there is not reliable timing, the shell is not stripped for delivery when it should be. This could result in an internal wreck within the tooling on the next stroke. Both the punch and die elements (carbide or tool steel) are expensive to say nothing of the loss in production due to down-time of the machine when a can shell hangs up on the punch. Similarly, a cup not properly located for the draw, precisely on the center line of the punch, can result in the same kind of damage.

In a machine where power is derived from a fly wheel effect, involving drive shafts, cams, bell cranks and other elements mechanically inter-connected seldom if ever can an internal wreck be anticipated sufficiently in advance to avoid a wreck, let alone stopping the fly wheel effect if there is indeed a function failure. The punch of the present invention is controlled hydraulically, not mechanically. This makes it possible to sense for attainment of each precedent function necessary for a successful completion of the next subsequent function and to discontinue punch travel if attainment of the precedent function is not sensed. Indeed it is possible to rely on redundant sensing giving all the more assurance that a shell will be properly formed. It is therefore another object of the present invention to incorporate in a machine for producing can shells, having a punch powered hydraulically, sensing means to identify a cup properly positioned, a shell properly formed therefrom, and a shell stripped in combination with means which constantly monitor the punch stroke so that if there is failure to sense attainment of the corresponding cup or shell condition at a time when continuation of the punch stroke or reversal of the punch stroke requires the condition to be satisfied, then delivery of fluid under pressure for operating the punch is stopped, thereby avoiding an anticipated wreck at the shell forming station.

In this connection, one of the sensing means is an unusual form of so-called short can detector. It is necessary to determine if the side wall of the shell is fully extended rearward of the punch as a result of ironing, because if the shell is short, a possibility (among several) is there was a flaw in the starting cup or blank which resulted in a fragmented shell, leaving a loose piece in the die area. There are disadvantages in having a short can sensing means operate on the principle of physical contact or calipering. There are many reasons, but it is enough to mention that the presence of a coolant renders physical contact unreliable. Consequently, another object of the invention is to sense for a short shell by discriminating between the metallurgy of the shell and the metallurgy of the punch without contacting either one. Specifically, an object of the invention is to sense or probe for a short shell by means of an inductance which will vary depending upon whether the field of the inductor is interdicted by the metal of the punch (short shell) or by the metal of the shell, meaning a shell of the right size.

The objectives set forth above can be attained, especially the proposition of being able to stop the punch at any part of its travel, if hydraulics are employed and attainment of essential functions are monitored by electrical circuitry and so to do constitutes another object of the invention. In this regard the machine incorporates a cup positioning plunger for feeding a cup from a stand-by position to a ready position at the die station, and in view of this another object of the invention is to allow the punch to approach the initial drawing die only if the cup positioner has advanced in the meantime and if it is determined the cup has been precisely positioned on the center line of punch travel. Satisfaction of these coincident conditions is necessary in order that fluid under pressure may be applied to a ram which carries the punch. The punch is driven forward through a draw and iron stroke in one direction predetermined as adequate to shape a shell from the cup.

The machine, as already noted, embodies a double-ended punch, requiring a double-acting piston or ram to move the punch in opposed directions. The arrangement is such that while one shell is being formed at one station (on the right for example) by the advancing punch, the shell (ideally) on the left is being stripped from its punch. In compliance with another object of the invention, full advance of the punch on the right is not allowed to occur if a short shell is detected on the left, nor shall there be full advance of the punch on the right if the cup on the right was not fed and is not located on the punch center line as already noted; and vice versa. Thus it is an object of the invention, using a double-ended punch to form can shells successively, to allow travel of the punch from a first forming station into a second forming station, even though there is a cup in ready position at the second station, only if there is assurance the can was properly formed at the first station.

It will be seen that a reference point, constantly to be maintained, is to have the cup, to be re-drawn and ironed into a thin-walled shell of much greater length, on the center line of the punch. The punch is driven hydraulically, having a double-headed ram located inside a cylinder block. The hydraulic fluid will become hot, noting that the punch may be reversed two hundred times a minute under ideal circumstances, meaning four hundred shells per minute. The cylinder block has a horizontal axis. The cylinder block may get so hot as 140° F while other parts of the machine, notably the die rings and their supports, may be at room temperature. If the cylinder block (at 140° F) is supported on the top of a pedestal (at 70° F) the cylinder block will expand upwardly and its center line is raised relative to the die station. There is a lack of symmetry. Consequently another object of the invention is to suspend the cylinder block in such a fashion that symmetry of the cylinder block and punch axis is effectively maintained relative to the die axis regardless of any temperature differential between the cylinder block and the die (and ironing) rings at the shell forming station. A related object is to allow equal heat expansion (or contraction) parallel to the cylinder axis.

Derivation of logic language (binary coding) is not part of the invention since this is a matter of systematic programming. However, it is part of the invention, as another object, to track (monitor) movement of the punch and the cup positioner by relying on voltage analogs and more specifically to accomplish this by using linear variable differential transformers the output of which signifies to a logic control achievement of functions (punch position; cup feed position) as conditions precedent for continuing movement of the punch. So to do eliminates the need to employ limit switches of the kind which physically check attainment of positions. The attainment of this object contributes to a higher production rate since there is no delay due to the opening and closing of switch contacts let alone the need to indulge in switch adjustment and sophisticated switch configurations.

Another object of the invention is to develop a control system by which a critical condition of the product being produced by the machine is monitored along with one or more operating conditions of the machine; both the product condition and the machine condition must be in compliance with performance criteria in order for production to continue.

In a machine for making cans, heat is generated in the die stack during the time the cup is deformed to the longer, thin-walled shell form. This heat, unless removed, can produce reflow of the metal constituting the thin-walled shell; also the die stack can be overheated. In one event, the shell is ruined; in the other event, the life of the dies is shortened. It is customary, therefore, to drench the die stack with a coolant to extract heat and such expedient may be employed during operation of the present machine.

Nonetheless, there are materials for cans, both present and prospective, having such little tolerance for over-heating that an enormous effort, or certainly one at considerable cost, would be required to extract heat by the known expedients.

This problem is of considerable importance from the standpoint of a sustained high production rate because if the production rate of shells is to be increased, certainly one approach is to operate the punch faster. However, in the instance of a punch operated by the flywheel effect, peak velocity is attained inside the die stack by the very nature of the harmonic motion of a punch body extended and reversed by rotational (flywheel) energy. In fact, the punch body, when deforming the cup, has a horsepower input in excess of the energy required for mere deformation. The cup is deformed so fast there may be insufficient time to extract heat at the rate deemed necessary to assure against reflow or excessive softening of certain materials constituting the wall of the shell, certainly some of the prospective materials.

It is therefore another object of the present invention to operate the punch body with just enough force to attain the desired deformation of the cup. It is another object of the invention to force the punch body through the die at a substantially uniform velocity, which allows sufficient time to extract heat economically at a rate which assures overheating will not occur. This is accomplished by operating the punch body with a hydraulic force, enabling peak velocity to be imparted before the punch body drives the cup through the die stack. Thus, the velocity of the punch body when deforming and extending the cup to thin-walled shell form inside the die stack is substantially constant and linear except for those fluctuations which characterize resistance as the successive drawing (or ironing) rings are encountered.

It may seem that under the present invention the possibility of damage due to heat is obviated by sacrificing speed, thereby resulting in a lower production rate. Such is not the case, for at least two reasons. First of all, machine down-time to accomplish repairs (or remove damaged shells inside the die stack) caused by excessive heat subtracts from the production rate.

The second reason entails consideration of one feature of an ideal punch body stroke. The ideal point for commencement of the punch body stroke would be the point where the end of the punch (engageable with the cup bottom interior) is retracted from the first die just sufficient to afford space to feed the cup to the punch body axis without interference by the punch end or the die ring, that and no more, within practical tolerances of course. But with a punch body driven by a conventional crankshaft-flywheel principle, this is not practical, except it be accomplished by some means unknown to us, because when the end of the punch being retracted has attained the ideal point, the harmonic cycle is itself incomplete, which is to say bottom-dead-center (or top-dead-center, depending on the point of view) has not yet been attained. The dead-center position is attained afterwards, displaced a considerable distance beyond the ideal point, and this same distance must be traversed during the opening portion of the next harmonic cycle. There is lost motion and no work is done. But under the present invention, the punch body can be stopped at the ideal point for cup positioning; the stroke is therefore shortened, and while the peak velocity may be less, compared to a flywheel drive, the punch has less distance to travel, meaning the time lost on one hand (with the advantage already mentioned) is gained on the other. These explanations account for additional objectives of the invention, which are to attain more nearly an ideal punch body stroke from the standpoint of distance traveled and to enable the punch body to dwell at the end of each stroke during which time a cup to be deformed can be fed to position on the punch body center line, as explained in more detail hereinafter.

Other objects of the invention are: to valve operating fluid to the stripper in a unique manner and especially to incorporate a self-valving feature related to punch body reverse travel; to valve air under pressure through the stripper in a unique manner to support the shell against collapse during retraction of the punch; to retract the stripper at an accelerated rate, after the shell is stripped, by means including a spring which stores energy during punch body retraction and to ease the stripper into home position at the completion of stripper retraction; to employ compressed air to aid the spring when retracting the stripper; and to enable repair and replacement of the punch elements to be easily accomplished.

GENERAL DESCRIPTION

Figure 1:
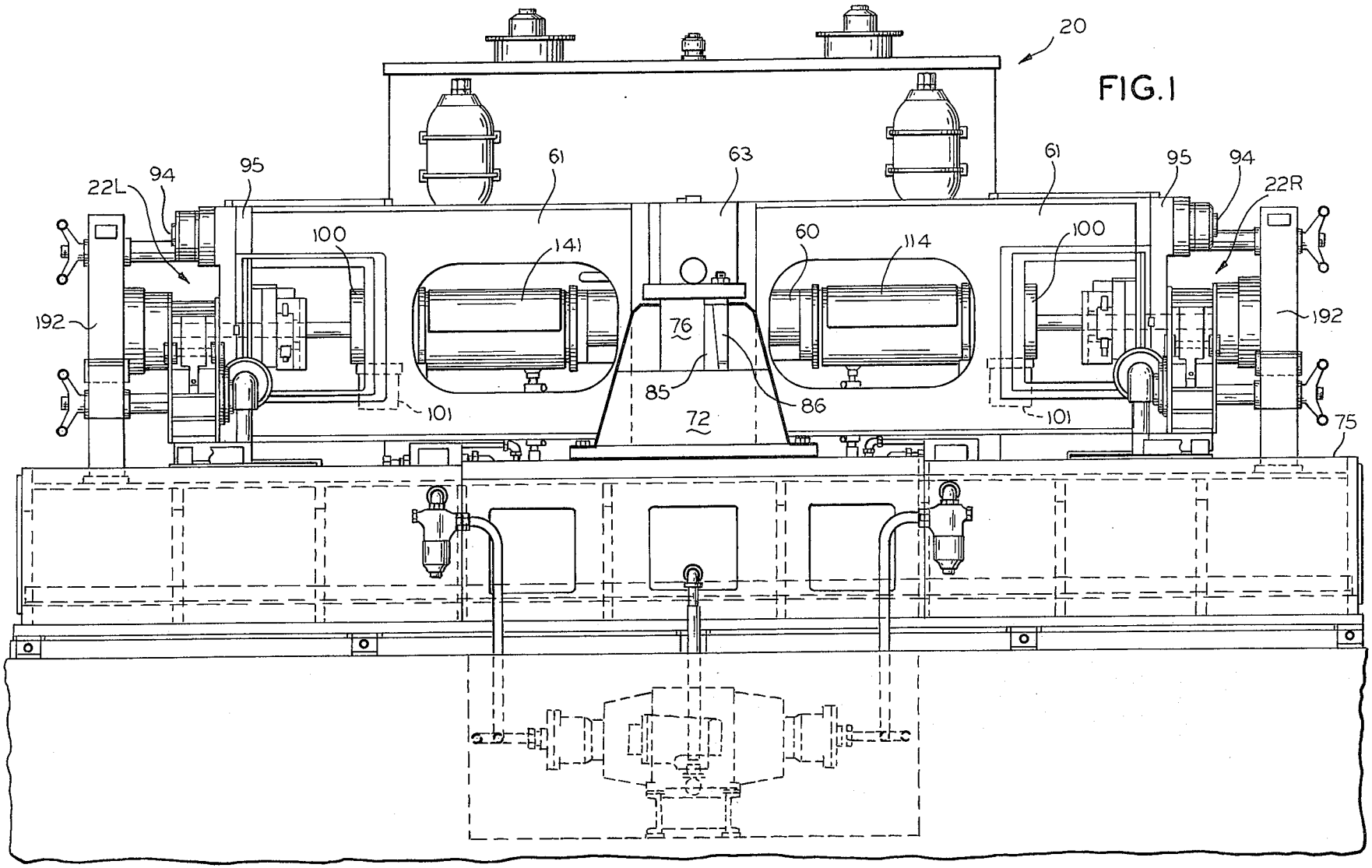
FIG. 1 is a front elevation of a machine constructed in accordance with the present invention.
Figures 8, 8A, 8B, 8C:
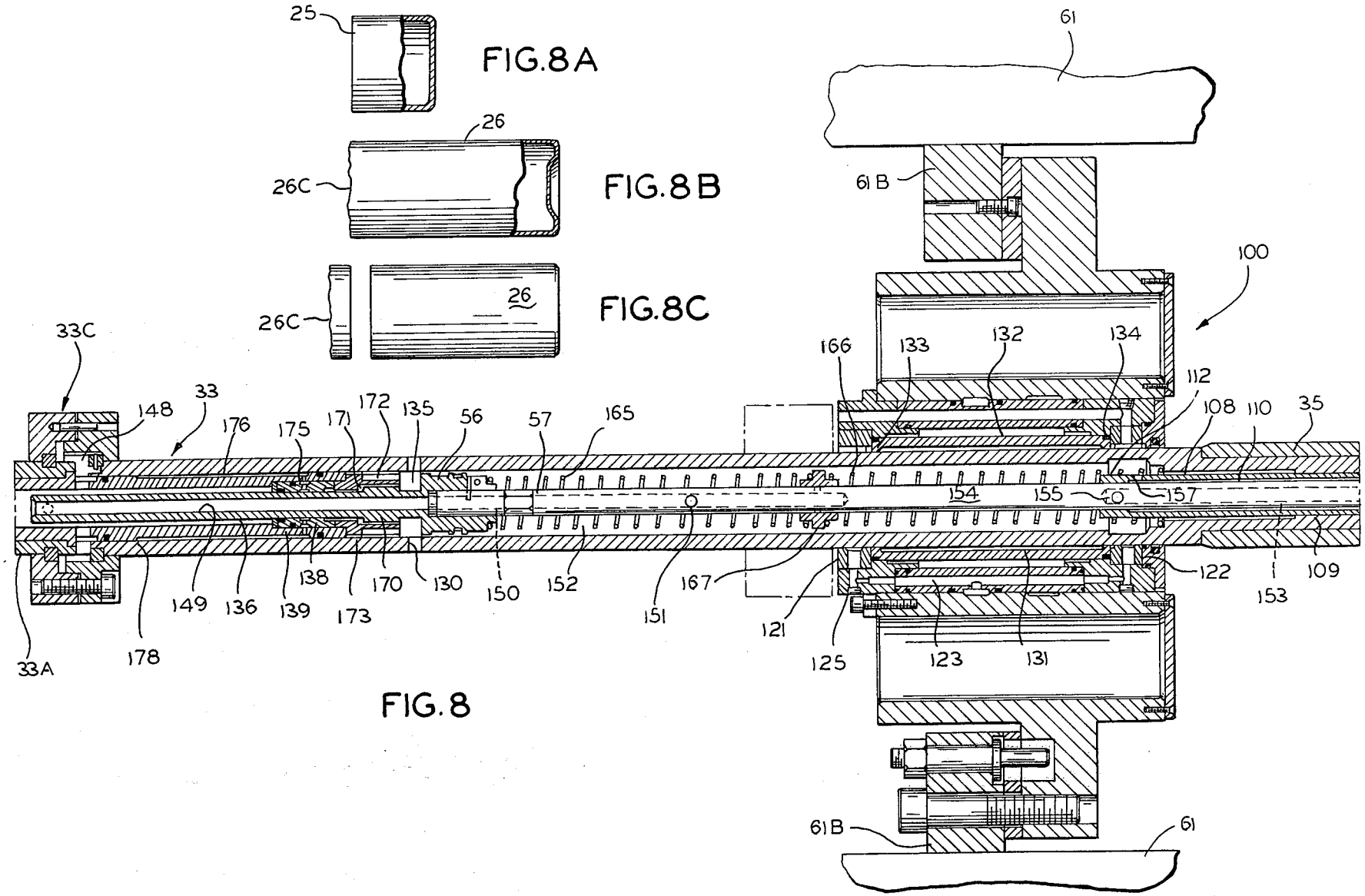
FIG. 8 is a sectional view of the punch body, being an extension of the right hand side of FIG. 7 on the scale of FIG. 7.
FIG. 8A is a detail view, partly in section, of a cup blank.
FIG. 8B is a detail, partly in section, of a shell formed from the cup shown in FIG. 8A.
FIG. 8C is a detail view of the shell, having one end trimmed off.

The machine 20, FIG. 1, embodies two opposed forming stations, 22L and 22R (left and right) where a cup 25, FIG. 8A, is first drawn and then ironed in successive stages to produce a shell 26, FIG. 8B, from which a can is ultimately completed. The shell has a wavy or so-called eared free edge in the form of an irregular curve 26C, FIG. 8B. This portion, at the top of the shell, is subsequently trimmed (FIG. 8C) at another station (not shown) and the manner in which this is accomplished constitutes no part of the present invention.

Figure 7:
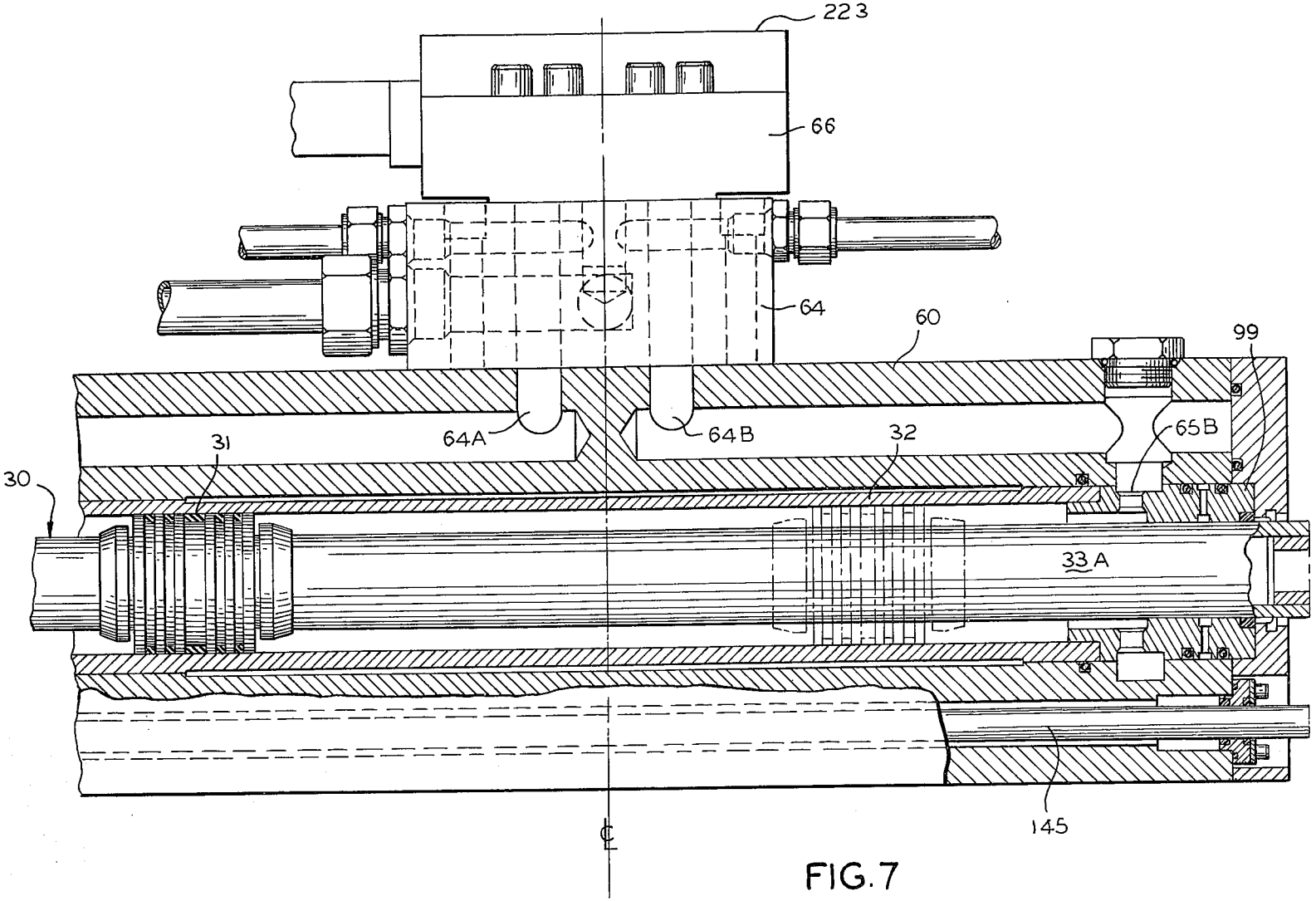
FIG. 7 is a sectional view of the main cylinder on an enlarged scale.
Figure 9:
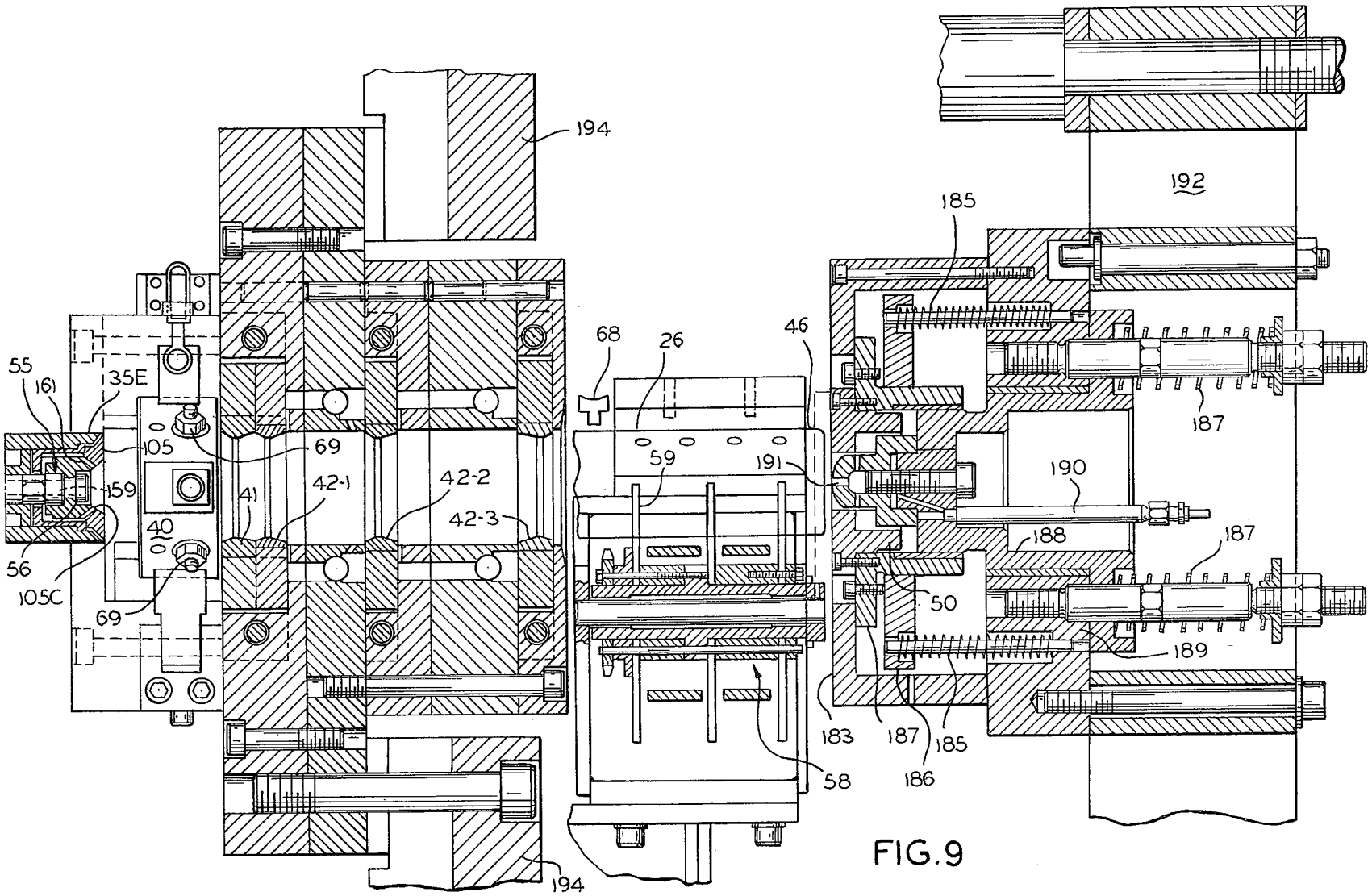
FIG. 9 is a sectional view as an extension of the right hand end of FIG. 8 and on the scale of FIG. 8.

The shell forming stations 22L and 22R are located at the opposite ends of the double-acting punch structure 30, FIG. 7. The punch has a piston assembly (or ram) 31 located inside a punch cylinder 32. The full extent of the right-hand side of the punch structure is shown progressively in FIGS. 7, 8 and 9, including an elongated punch body 33 of tubular form and a punch sleeve 35, the terminal end 35E of which is shown in FIG. 9. The punch structure on the left-hand side of the ram 31 is of identical form, and this is equally true of the drawing and ironing dies, the dome tooling and the shell discharge turret hereinafter described in connection with the right-hand extent of the punch structure. Consequently what is specified for the right extent of the machine is duplicated to the left of the ram or piston assembly 31.

The cup to be drawn will be located behind a cup holder 40, FIG. 9. Thereafter, the punch is advanced to force the cup first through a drawing die 41 and thereafter through a series of ironing dies 42-1, 42-2 and 42-3, resulting in the elongated can shell.

In most production runs the bottom 46 of the shell, FIG. 9, will be pressed against a doming tool 50 to bend the bottom of the shell inward.

To strip and remove the completed shell from the punch sleeve 35, a stripper 55, FIG. 9, is located inside the punch sleeve. When the punch has attained its forwardmost advanced position on the forward stroke to the right, forcing the bottom of the shell against the doming tool 50, the punch body 33 is retracted and concurrently fluid under pressure is delivered to a piston 56 carried by a stripper rod 57, thereby holding the bottom of the shell at the forming station while the punch body is reversed incidental to drawing and ironing a second cup at the left-hand forming station 22L.

After the shell 26, FIG. 9, has been stripped, which is to say that after the punch sleeve 35 has been completely withdrawn therefrom, the stripper is also retracted and the shell is ready to be delivered to a trimmer by a turret 58 having cradles 59 which capture the ironed shell.

The punch cylinder 32 is contained within a cylinder block 60, FIGS. 1 and 7. The cylinder block (not shown in FIG. 2) is located between side plates 61, FIG. 2. The cylinder block is suspended by a pair of inwardly directed trunnion arms or stubs 62, FIG. 4, which fit in cavities in the side walls of the cylinder block 60. Each stub arm 62 is part of a center support block 63 positioned between the inner ends of the side plates 61, on each side of the machine, FIG. 2. The bottom of the cylinder block 60 is not directly supported for reasons to be explained.

Figure 13:
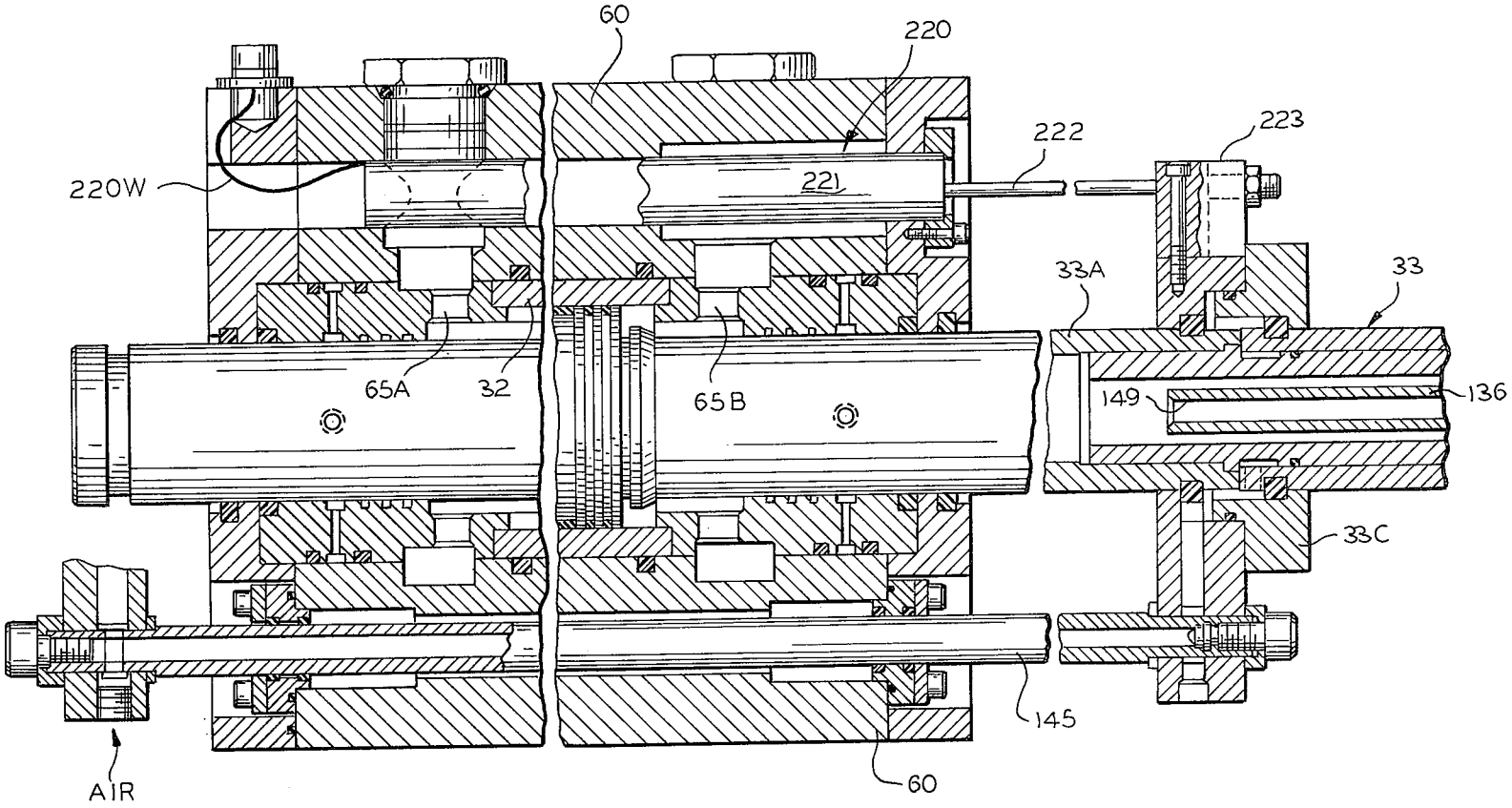
FIG. 13 is a sectional view of the main cylinder and the transducer related thereto.

Fluid under pressure for driving the punch body is delivered through an internally ported manifold 64, FIG. 7, and is directed through a port 64A or 64B to a related passage in the cylinder block to a delivery port communicating with either the right-hand or left-hand side of the ram or piston head 31, depending upon whether the logic command is for left-hand or right-hand travel of the punch body. The delivery port for left-hand travel of the punch body is identified by reference character 65B in FIG. 7. A similar delivering port 65A, FIG. 13, is provided for opposite punch body travel.

A valve 66 determines the direction of fluid flow for driving the punch and whether or not there shall be delivery of operating fluid. In this connection, a sensor 68 for detecting a fully ironed shell, FIG. 9, is located at each forming station. This sensor is part of the control and distinguishes between the metallurgy of the shell and that of the punch sleeve 35. If the metal of the punch sleeve is detected at a time when punch travel should have produced a fully extended shell, the servo valve 66 is set to null position, preventing reversal of the punch body. If the shell is steel or tin-coated steel, the punch sleeve is preferably tungsten carbide and the end of the stripper will be steel; if the shell is aluminum, the punch elements will be tool steel.

Travel of the punch body is also stopped by the servo valve in null position if sensors 69, FIG. 9, do not detect a cup on the center line of the punch. There are other unfulfilled conditions which result in stopping punch travel as will be described.

The punch body and stripper are so coupled as to advance together in one direction to force the cup through the die station, bottoming the resultant shell against the doming tool to indent the bottom of the shell, whereupon the stripper holds the shell while the punch is withdrawn in the course of its reverse stroke, as already noted. Clearly this aspect of the invention and other functions as well can be incorporated in a machine having a single acting, rather than a double acting, punch and stripper. In a double acting punch structure, a forward stroke of the punch in one direction may be viewed as starting at either station 22L or 22R and terminating at the other; vice versa for the reverse or restoring stroke of the punch without regard to whether the ram or piston assembly 31 is centered in the cylinder sleeve 32. If related features of the invention are embodied in a single acting punch, the punch may be doing no useful work during its reverse stroke except to free the shell for delivery. Accordingly, it will be seen that the forward stroke is characterized by formation of a shell from a cup at a die station while the reverse or retraction stroke is characterized by stripping that shell; in a double acting machine reverse motion is continued to form a shell at a second station.

Suspension of the Cylinder Block; Support of the Punch Structure

Figure 2:
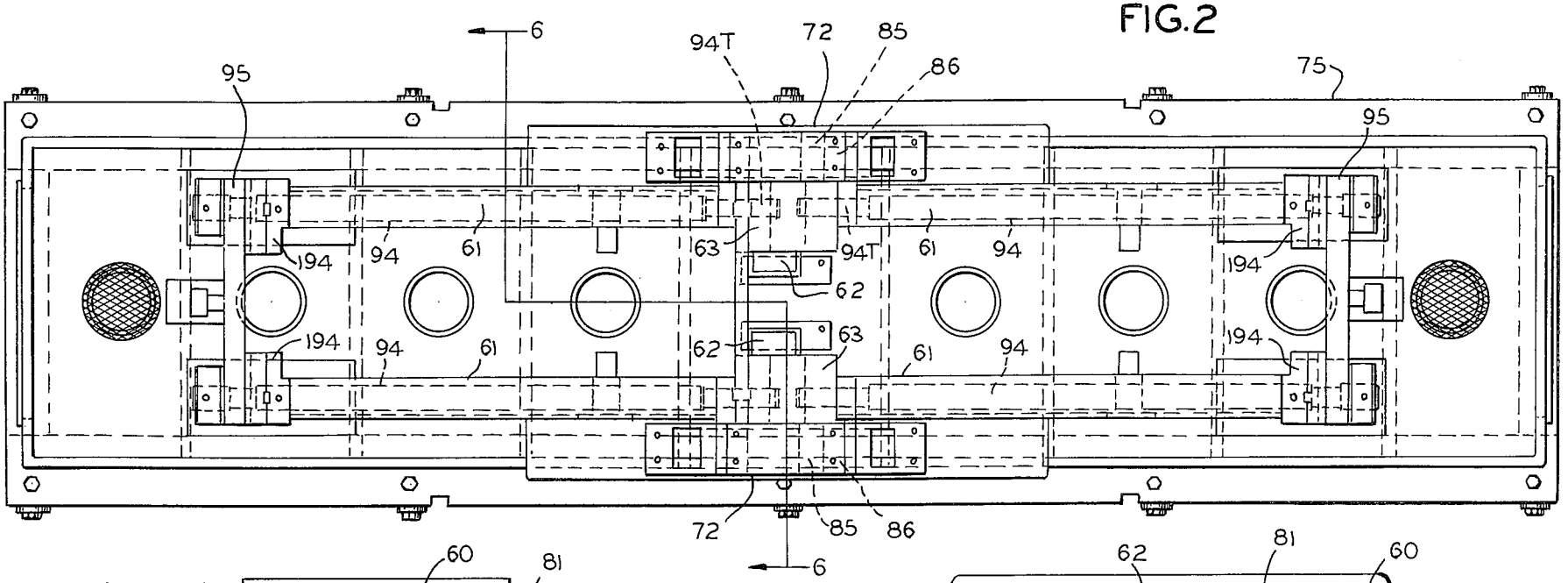
FIG. 2 is a top plan view of the machine shown in FIG. 1 with certain parts removed for clarity.
Figure 5:
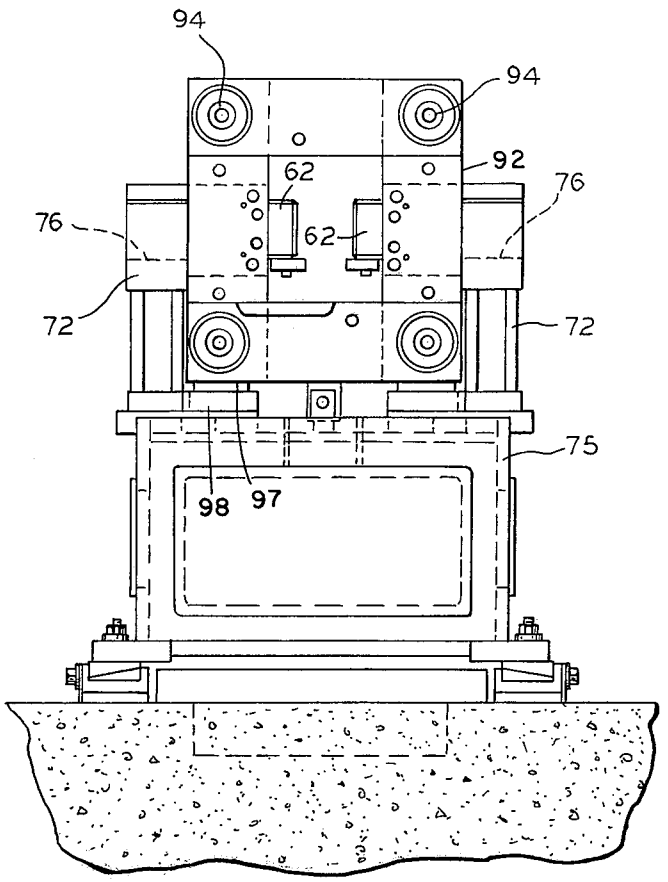
FIG. 5 is an end view of FIG. 2.

In order to assure continual symmetry between the center line of the punch and the center line of the die structure, that is, to assure that these two axes are constantly co-axial for all practical purposes, the cylinder block is suspended at its geometrical center and is not supported at its underside. To accomplish this, a pair of vertical support posts 72 of identical configuration, FIGS. 2 and 5, are in turn supported on the bed 75 of the machine. The center support blocks 63 are located substantially at the geometrical center of the machine. Each center block 63 is fabricated to include an outwardly extending support arm 76, FIG. 6, which reposes in a slot 77 formed in the related supported post 72.

Each center block 63 includes an inwardly extending trunnion arm or stub 62 as already noted. Each of the arms 62 is for the purpose of suspending the cylinder block and extends into a related slot or cavity 81 presented at opposed sides of the cylinder block, FIG. 4.

Figure 3:
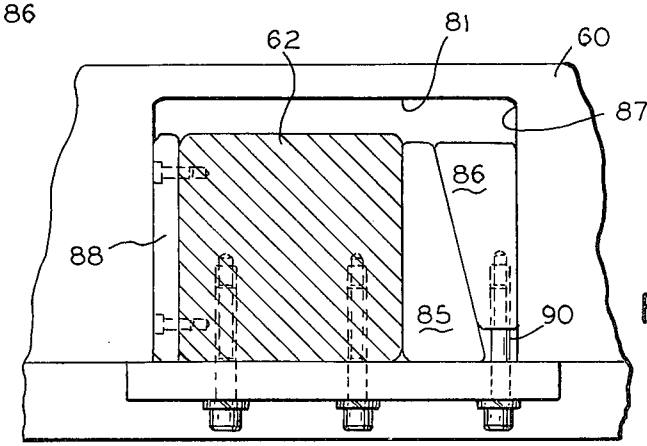
FIG. 3 is a fragmentary view of part of the main cylinder support, partly in section.
Figure 4:
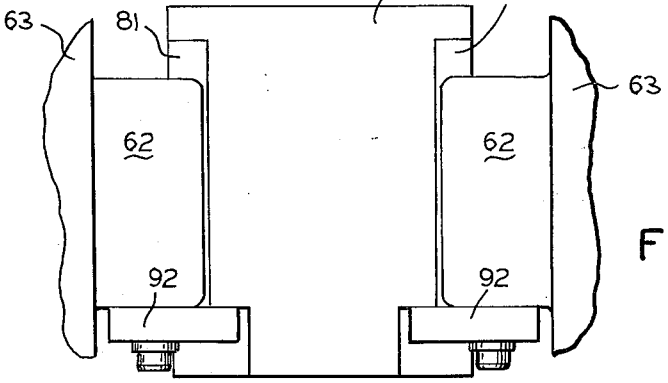
FIG. 4 is a fragmentary elevation showing certain aspects of the support for the main cylinder.

To stabilize the cylinder block, a pair of wedge blocks 85 and 86, FIG. 3, are interposed between each arm 62 and the opposed wall 87 of the cylinder block mounting cavity 81. This prevails on each side of the cylinder block as shown in FIG. 2. A shim 88 is preferably fastened to the opposite side of the cylinder block suspension arm 62. By drawing each wedge 86 downwardly into tight engagement with the opposed wedge 85 by means of a screw 90, the cylinder block is in effect clamped securely in place, but nonetheless, as shown in FIG. 4, there is minimal contact between the surfaces of the cylinder block and the suspending arms 62. A pair of lugs 92, fastened to the under side of the suspending arms 62, are used to support the cylinder block 60 temporarily during assembly.

It will thus be seen that the cylinder block is not supported at its bottom and is not supported directly on the bed of the machine. The bed of the machine ordinarily will be at room temperature, compared to the temperature of the cylinder block during sustained operation of the machine which may be as high as 140°F. Consequently, by suspending the cylinder block in the manner described with the points of suspension presented by the stub arms 62 being at the geometrical center of the cylinder block, non-symmetrical expansion of the latter, considered in terms of the center line of the die structure is nil.

The side plates 61 are accurately spaced laterally and stabilized as well by eight tie rods 94, FIG. 2. The outer ends of the tie rods, FIG. 1, are rigidly supported by ends plates 95, and the inner ends are threadedly mounted at 94T in the center support blocks 63, FIG. 2.

Figure 6:
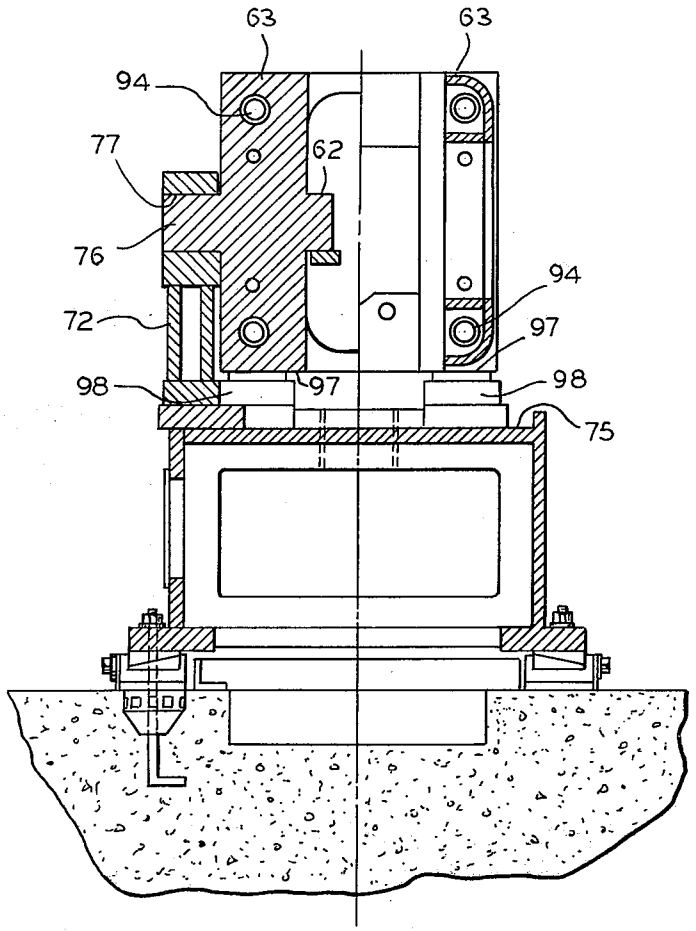
FIG. 6 is a sectional view on the line 6—6 of FIG. 2.

To assure equal thermal expansion and contraction of the side plates 61 and therefore longitudinal symmetry of the die stations which are supported by and between the end plates, the lower surfaces 97 of the side plates, FIG. 6, repose freely on opposed surfaces of bolster pads 98 in turn supported on the bed of the machine.

In the actual machine the punch structure is of considerable length, nearly eleven feet between the left and right-hand punch ends. The bed of the machine is nearly sixteen feet long. To support and guide the punch body there are a pair of bearings inside the cylinder block on opposite sides of the ram head, one of which is identified at 99, FIG. 7. Additionally, there are a pair of relatively large bushings 100, FIG. 1, which encompass the punch body on opposite sides of the cylinder block. The bushings 100 are securely attached to support lugs 61B presented by the side plates 61 as shown in FIG. 8.

The bushings 100 are also employed in transmitting operating fluid to the piston 56 of the stripper in cooperation with a valve 101, FIG. 1, supported by each bushing.

Punch Body and Stripper Assembly; Operation

The details of construction will first be set forth; operation as a whole will then be explained.

The punch body 33 is of tubular form and concentrically surrounds the stripper 55 which is co-axial therewith. The punch body is joined to a cylinder rod 33A, FIGS. 7 and 8, the two being rigidly connected by the split halves of a coupling 33C.

The stripper assembly is identified collectively by reference character 55, FIG. 9. More specifically, the stripper includes a piston 56, FIG. 8, fastened to an elongated piston rod 57. To supplement the punch sleeve element 35 which is separately supported at one end of the tubular punch body 33, the end of the stripper rod 57 opposite the piston 56 is provided with a so-called nose cone in the form of a punch element 105, FIG. 9, fastened to the right-hand end of the stripper rod 57 by a fastener 106 which is hollow for reasons to be explained.

The exposed or free end of the punch element 105, carried by the stripper, is concave at 105C, FIG. 9, complemental to the convex end of the doming tool 50.

As noted above the stripper is supported and arranged for movement independently of the punch body. The stripper is guided and supported in part by the close fit between the piston head 56 and the inside diameter of the punch body 33. This is supplemented by a guide bushing in the form of a bronze sleeve 108, FIG. 8, secured to a reduced diameter portion 109 on the inside of the punch body. The bushing 108, throughout the major extent of its length, is enlarged to afford an air chamber 110 and the extreme ends thereof are reduced to afford two guide ring bushings 112 and 113, FIGS. 8 and 9, which slidably engage the outside diameter of the stripper rod 57 in a seal fit to seal chamber 110.

To replace the punch elements it is merely necessary to remove the fastener 106, FIG. 9. The punch element 105 may then be extracted and the punch sleeve 35 as well incidental to replacing a worn punch or substituting a punch of different configuration or changing from a punch of one metallurgy to another.

The punch body and stripper are coupled to advance together during the forward stroke, FIG. 7, characterized by the delivery of fluid under pressure to the left-hand side of the ram 31. Concurrent or simultaneous movement of the assembly in this regard follows from the fact that the cup-engaging end 35E of the punch sleeve on the punch body complementally fits the rear face of the punch element 105 of the stripper, in turn secured to the stripper rod 57.

Each of the bushing support structures 100 embodies a pair of hydrostatically balanced bearings 121 and 122, FIG. 8, which constitute spaced bearing supports for the punch body tube or sleeve 33. Fluid is supplied to the bearings 121 and 122 from a supply chamber 123 housed by an enlarged bushing sleeve 125. Hydrostatically balanced bearings are preferred but are not necessary.

To control the delivery of fluid under pressure for operating the stripper, the punch body 33 is provided with a port 130, FIG. 8, which is related to a supply chamber 131 afforded by the bushing 100. This relation, of course, prevails for each side of the punch. Chamber 131 is presented by a sleeve 132 secured to the bushing support 100. The sleeve has two end rings 133 and 134 encompassing the punch body in a seal fit.

The port 130 has an outer or ambient end normally exposed to ambient pressure when it is disclosed with respect to the supply chamber 131. The opposite or inner end of the port 130 is in constant communication with a cylinder area 135 inside the punch body affording a cylinder for the stripper piston 56. The stripper piston 56 includes an elongated, rearwardly extended stem 136 having several functions explained in detail hereinafter but it may be mentioned at this point that the stem 136, secured as it is to the stripper rod 57 for movement therewith, is embraced by a guide bushing assembly 138 of generous length carried by a support sleeve 139 in fixed position inside the punch body.

The portion of the punch body between the large bushing support member 100 and the cylinder block is normally housed by a cover 141, FIG. 1, which captures oil emitting from the port 130, emitted as a result of stripper retraction as will be explained below. The inside of the housing, however, is at ambient pressure.

When a shell is stripped, air under pressure is supplied to the nose cone 105. To accomplish this a manifold 145, FIGS. 7 and 13, for supplying stripper air under pressure is attached to the coupling 33C, FIG. 13. The manifold slides within a chamber presented by the cylinder block 60. Air supplied to the manifold is communicated to a chamber 148, FIG. 8, in the coupling 33C by connecting ports which are evident. The stem 136 extending rearward from the piston 56 is hollow, affording a passage 149 which communicates with chamber 148.

The piston rod 57 is in part hollow, having a first passage 150 communicating with passage 149. The piston rod has a first port 151 in its wall, communicating with passage 150 and allowing pressurized air to collect inside the punch body in the area 152 between the front of the stripper piston and the bronze sleeve 108.

The piston rod has a second hollow portion 153, separated from the first by an intervening solid portion, 154. A second air port 155 is formed in the stripper rod. This port is normally encompassed and therefore sealed by the bushing ring 112 at the left end of the bronze sleeve 108.

The wall of sleeve 108 which affords the air chamber 110 has a port 157 therein adapted to communicate air inside the punch body to one end of passage 153 when port 155 is disclosed to port 157 in a manner to be explained. Passage 153 at its other end communicates with a passage 159 in the hollow fastener 106, FIG. 9.

The nose cone 105 characterizing the punch end of the stripper is formed with passages 161, FIG. 9. These passages extend from the concave part of the nose cone to the back of the nose cone.

When the shell is stripped as hereinafter explained in more detail, air is supplied through the passages and ports just described, the hollow stripper rod serving in part as a conduit for air emitting from the nose cone and impinging on the inside of the bottom of the shell. As the punch sleeve 35 retracts, air escapes at the back of the nose cone and fills the space opened by the retreating end of the punch sleeve, preventing a vacuum which would cause the shell to collapse.

To retract the stripper an elongated coil spring assembly, including two springs, 165 and 166, unified by a spring guide 167, surrounds the stripper rod. One end of the spring is captured by the front side of piston 56 and the opposite end of the spring bears against an internal shoulder on the punch body as will be evident in FIG. 8. Accordingly, the spring is compressed in the course of reverse travel of the punch body, storing energy which is released to retract the stripper after the shell is stripped. The action of the spring is assisted by air under pressure, inside the punch body chamber 152, acting on the front of the stripper piston 56.

Operation of the punch and stripper will now be recapitulated in connection with several different positions of the punch body and stripper shown progressively in FIGS. 8 (taken with FIG. 9) 10, 11 and 12; additional details of construction will be set forth in connection with absorbing spring thrust on the stripper during retraction of the stripper.

As shown in FIG. 9, the punch is retracted relative to the cup locater 40. If a cup has been positioned in locater 40 and if other functions are satisfied as hereinafter explained, forward travel is imparted to the punch body by fluid under pressure delivered to the left-hand side of ram 31; therefore, port 130 is approaching the supply chamber 131 in the bushing support 100. The spring 165-166 was previously extended and is not being compressed at this time. In fact, the punch body and stripper are moving together in a forward direction, to the right, at the same velocity, because the nose cone, FIG. 9, is in effect coupled to the end 35E of the punch sleeve 35. Consequently, air port 155 remains sealed by the seal bushing 112 on sleeve 108 carried by the punch body. Air under pressure prevails in chamber 152. Conjoint travel of the punch and stripper persists until after the punch is retracted.

Figures 10, 10A:
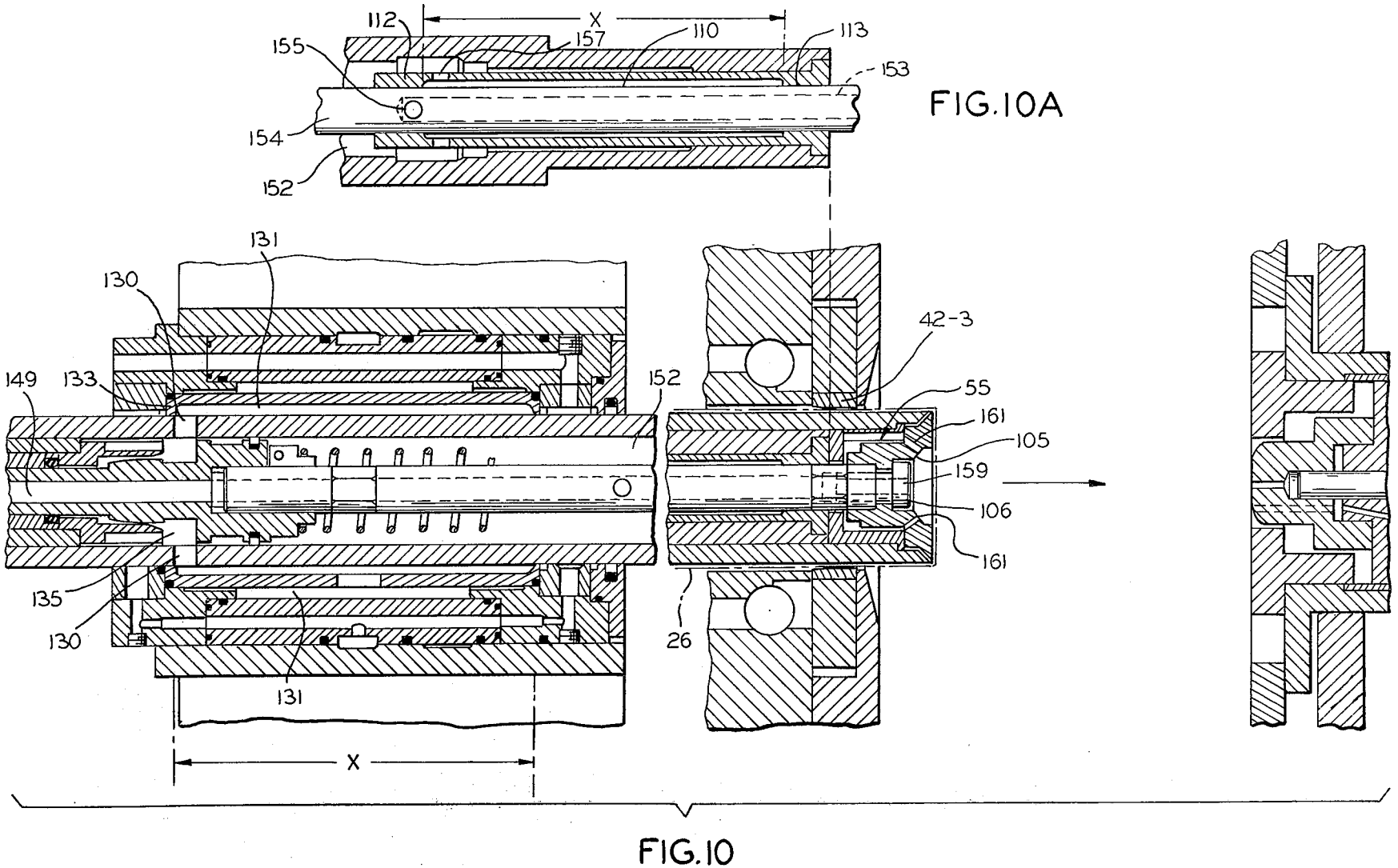
FIG. 10 is a sectional view of a portion of the punch body and the stripper means on an enlarged scale, approaching the dimpling tool during right hand extension.
FIG. 10A is a sectional view similar to and phased to FIG. 10 showing details of the stripper associated parts, prior to actuation.

Eventually port 130 is placed in communication with the supply chamber 131 as shown in FIG. 10. This occurs at a time when the punch is moving the almost completed shell through the ironing ring 42-3. Air is not yet ported to the nose cone, FIG. 10A.

Conjoint travel of the punch and stripper, at the same velocity, continue beyond the position shown in FIG. 10, and port 130 starts to traverse the length of the supply chamber 131; port 155 remains sealed and out of communication with port 157. Chamber 131 is not pressurized this time, but it will be seen that any time chamber 131 is pressurized, when port 130 is in communication therewith, fluid under pressure will be displaced into chamber 135 behind the piston 56 and this in fact is timed to occur shortly after the bottom of the shell has been dimpled by the doming tool, FIG. 11. There is a slight dwell (40 milliseconds in practice) after dimpling; that is, enough time to allow for cup feed at the other (left) station, whereupon the servo valve 66, FIG. 7, which services the punch cylinder is reversed or reset.

Figures 11, 11A:
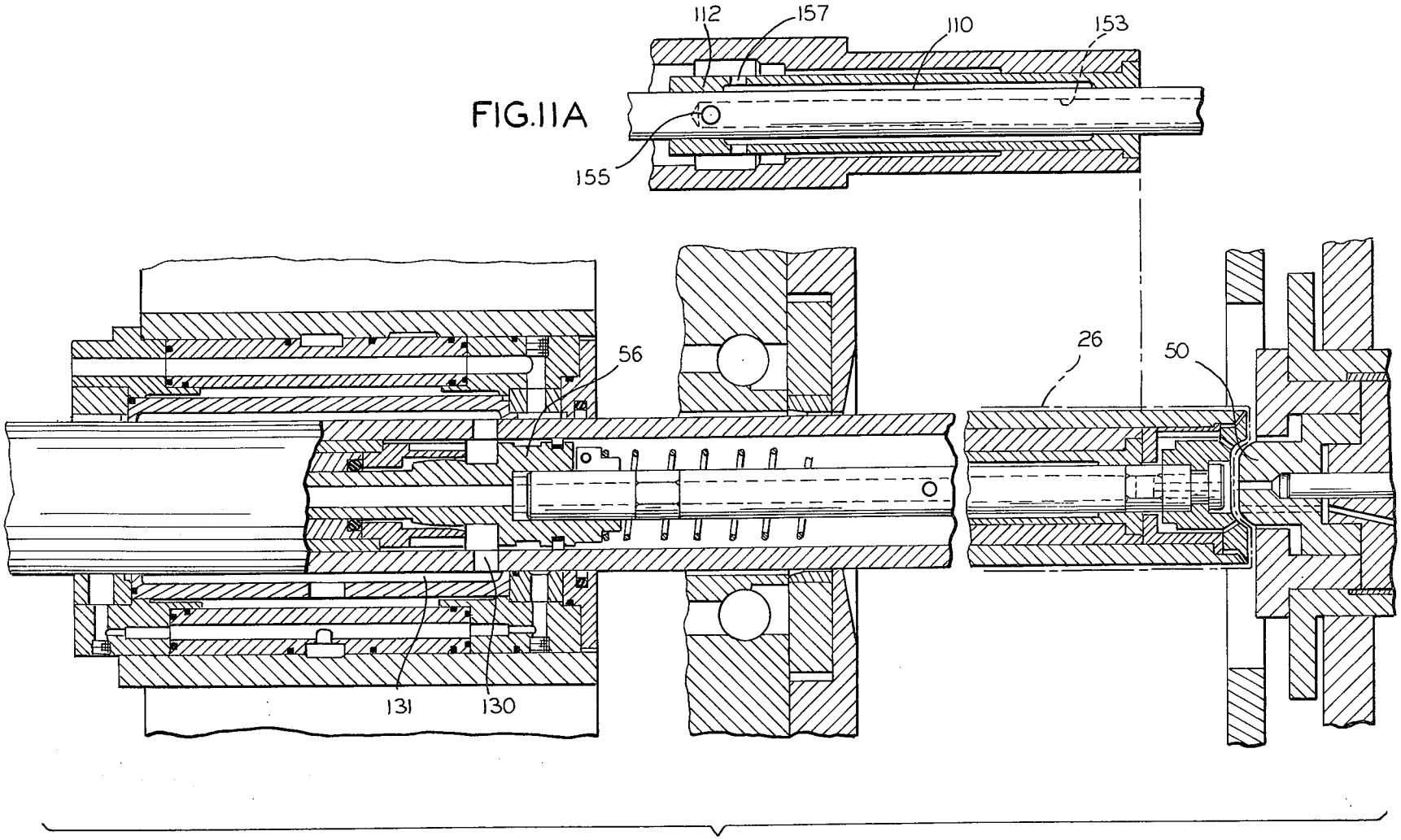
FIG. 11 is a sectional view of the punch body similar to FIG. 10 but showing the punch body in its fully extended right hand limit position.
FIG. 11A is a sectional view similar to and phased to FIG. 11, showing the advanced position of the stripper related parts.

Fluid under pressure is now delivered to the right-hand side of the ram to cause retraction of the punch; port 130 at this time is at the extreme right-hand side of chamber 131, FIG. 11, and concurrently valve 101, FIG. 1, is opened, delivering fluid under pressure to chamber 131, surging through port 130 to the cylinder 135 behind the piston 56. The force thus applied to the rear of piston 56 is sufficient to hold the nose cone or punch element 105 on the stripper against the bottom of the shell, holding it against the doming tool 50 as the punch is reversed, FIG. 11.

As the punch retracts there is relative movement between sleeve 108 and the stationary stripper rod 57. Therefore, as the punch retracts, bushing 112 will be displaced to the left of the position shown in FIG. 11A, placing port 155 in communication with port 157; air under pressure is now delivered from chamber 152 inside the punch body to passage 153 in the stripper rod and emits at the nose cone for the purpose described above, following the path of the arrows in FIG. 12.

Figures 12, 12A:
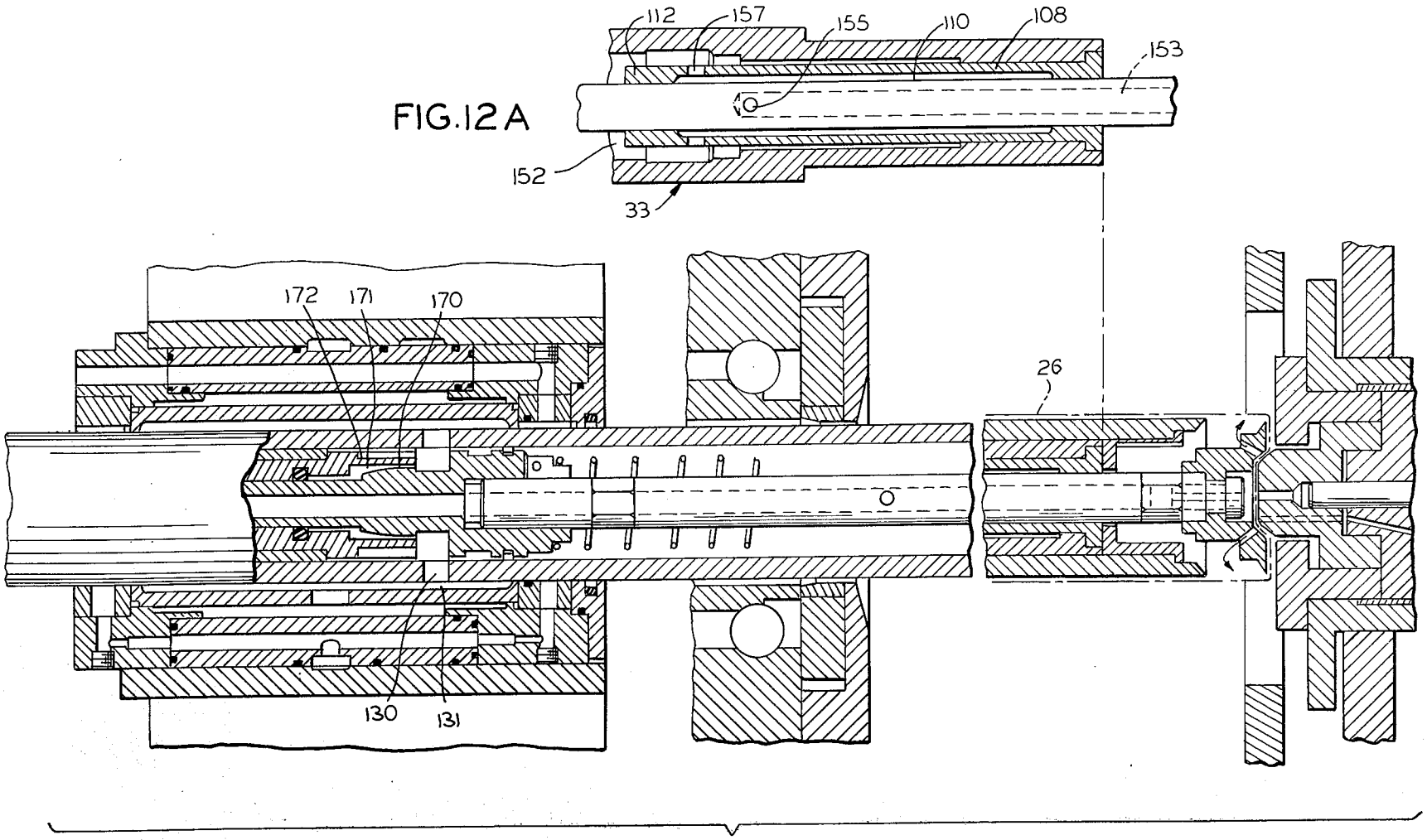
FIG. 12 is a sectional view similar to FIG. 11 showing the punch body being retracted from the stripper.
FIG. 12A is a sectional view similar to and phased to FIG. 12, showing the valving of air used during stripping action.

Inasmuch as chamber 131 and cylinder 135 have been pressurized, the stripper nose cone remains stationary and this condition prevails at all times as port 130 traverses chamber 131, retracing the original path, FIG. 12. This path is denoted X in FIG. 10, the length of chamber 131 which approximates the length of the finished shell. Path X should not be less than a shell length, but it may be more, especially to accommodate shells of maximum length. The same holds true for the air chamber 110, FIG. 10A, also denoted X.

In the meantime, the punch during its reverse stroke is compressing spring 165–166 to store energy. Stripper air continues to be supplied as the air chamber 110 traverses port 155, from right to left, FIGS. 11A and 12A.

Eventually port 130 clears the left end of the supply chamber 131 and there is an instant burst of pressurized fluid out port 130, this fluid being captured inside housing 141, FIG. 1.

Since the cylinder for piston 56 is no longer pressurized, energy in spring 165–166 is released. The stripper is rapidly retracted (eventually catching up with the reversing punch) and seal 112 closes air port 155. The compressed air inside chamber 152 no longer escapes through port 157; rather it acts on the front face of the stripper piston and aids the spring in retracting the stripper.

To prevent the stripper piston 56 from impacting the guide bushing 138, FIG. 8, when the spring restores the stripper, a shock absorber means is provided, relying on the return or reverse movement of the stripper assembly. This in effect involves a dash pot function obtained by providing a plunger 170, FIGS. 8 and 12, on the stem portion 136 of the stripper piston. The plunger 170 normally fits a chamber 171 presented by an enlarged end extension 172 on the bushing 138, bushing 138 being secured to the punch body for movement therewith. Rearward of chamber 171 there is an annular passage 173 surrounding the piston stem 136, FIG. 8.

When the spring assembly 165-166 expands as above described (aided by air) to retract the stripper, the latter is rapidly accelerated leftward in the direction of the retracting punch body. Eventually the plunger 170 attains home position inside chamber 171 and residual hydraulic fluid is compressed in chamber 171 by plunger 170, constituting a dash pot effect. The escape of the fluid being compressed (displaced) in chamber 171 is thereby retarded, bringing the stripper to a controlled, eased stop. The displaced fluid from chamber 171 escapes through ports 130. Some displaced fluid in chamber 171 leaks leftward along the area of bushing 138 which closely fits the piston stem 136. The leaking fluid attains a port 175 formed in the wall of bushing 138 and moves into a receiving chamber 176 presented by a reduced portion of the support sleeve 139. The collecting chamber 176 is vented to housing 141 by a port 178.

Port 130 is disclosed to chamber 131 and constantly ports cylinder 135 to chamber 131 as long as port 130 traverses chamber 131. Port 130 is self-valved to chamber 131 by the seal ring 133 on stationary sleeve 132. Similarly, port 155 constantly ports air passage 153 to port 157 when port 155 is traversed by air chamber 110 during punch body reverse travel. Port 155 is self-valved by the seal ring 112 on sleeve 108. Seal ring 112 normally closes port 155 but discloses it to chamber 110 at the commencement of punch body retractions; seal ring 112 closes port 155 once again when the stripper is retracted.

While the construction of the dome tooling for dimpling or indenting the bottom of the shell is known, there are certain features of the dome tooling which constitute an aid to understanding movement and formation of the shell. The shell 26, FIG. 9, appears to be cradled in the delivery turret 58; however, the shell as thus shown may be viewed as in transit to the right toward the doming tool, under the influence of the punch nearing the end of its forward stroke.

The dome tooling comprises a hold-down pad 182, normally located by a stop plate 183 to have its flat forward surface displaced just a few thousandths of an inch forward of the apex of the dome tool, being biased to this position by a light spring set 185. Spring 185 acts on a cross head assembly 186–187 which carries the hold-down pad 182.

The dome tool 50 in turn is normally urged forwardly by a heavy spring set 187 acting on a cross head 188 which supports the dome tool 50. The forward position of the dome tool is limited by a stop plate 189.

When the bottom 46 of the shell, FIG. 9, traverses the short distance separating it from the hold-down pad 182, the bottom of the shell is in effect clamped (by the opposed force of spring set 187) between the end of the punch and the hold-down pad 182. During the next increment of movement of forward punch travel, a few thousandths, the hold-down pad is pushed along by the shell and the punch presses the bottom of the shell against the dome tool 50. The heavy spring set 187 (and spring set 185 as well) opposes but does not stop the advancing punch. As the punch continues forward the bottom of the shell is bent inward; both the hold-down pad 182 and dome tool 50 continue to yield as the punch element bends the bottom of the shell around the radius of tool 50.

The dome tool 50 is spring biased constantly during dimpling, never bottoming against a fixed stop. The end of punch travel is a programmed signal as hereinafter described, programmed to occur after the punch has travelled far enough to cause the dimple to be formed. After the slight dwell previously mentioned, valve 101, FIG. 1, is opened and stripper air is applied by the self-porting features described above: port 130 to pressurized chamber 131; port 155 to port 157.

The return force of the heavy spring set 187 exceeds the holding force of the stripper piston. Therefore, as the punch body retracts, the doming tool returns to home position, until stopped. During this short amount of travel the stripper is pressed back slightly but the bottom of the shell continues to be held between the dome tool 50 and the punch element on the stripper.

To assure further the shell is retained at the doming station as the punch is withdrawn after the shell is domed, provision is made to apply a slight holding force to the outside of the shell. This is achieved by utilizing suction, negative pressure, that is, applied through a conduit 190 and self-evident porting, FIG. 9, including a port 191 which opens at the apex of the dome tool.

The dome tooling is rigidly supported by upright dome housings 192, left and right, FIG. 1, which in turn are supported on the bed of the machine.

Each die stack, left and right, collectively the draw and ironing dies, is rigidly secured as a unit to a pair of lugs 194, FIGS. 2 and 9, extended inward from the side plates.

Monitors: Tracking Punch Body Position and Cup Feed; Detecting the Condition of the Product Continuous and uninterrupted operation of the machine is manifest in continuous (double acting) reciprocation of the punch body in conjunction with synchronized feeding of cups to the cup positioners 40 at the entrance to the die stacks, both right and left, repeated detection of formation of shells of sufficient length, and successful stripping of the completed shells, ready for delivery. If there is failure to achieve any event, the punch body is stopped, at the very least. More briefly stated: if the product on one side of the punch is in satisfactory condition (drawn and ironed to sufficient length) and if the machine is performing satisfactorily (a cup is properly positioned on the center line of the punch at the other side and the punch body is fully extended) the punch and cup feeder means continue to operate.

Figure 15:
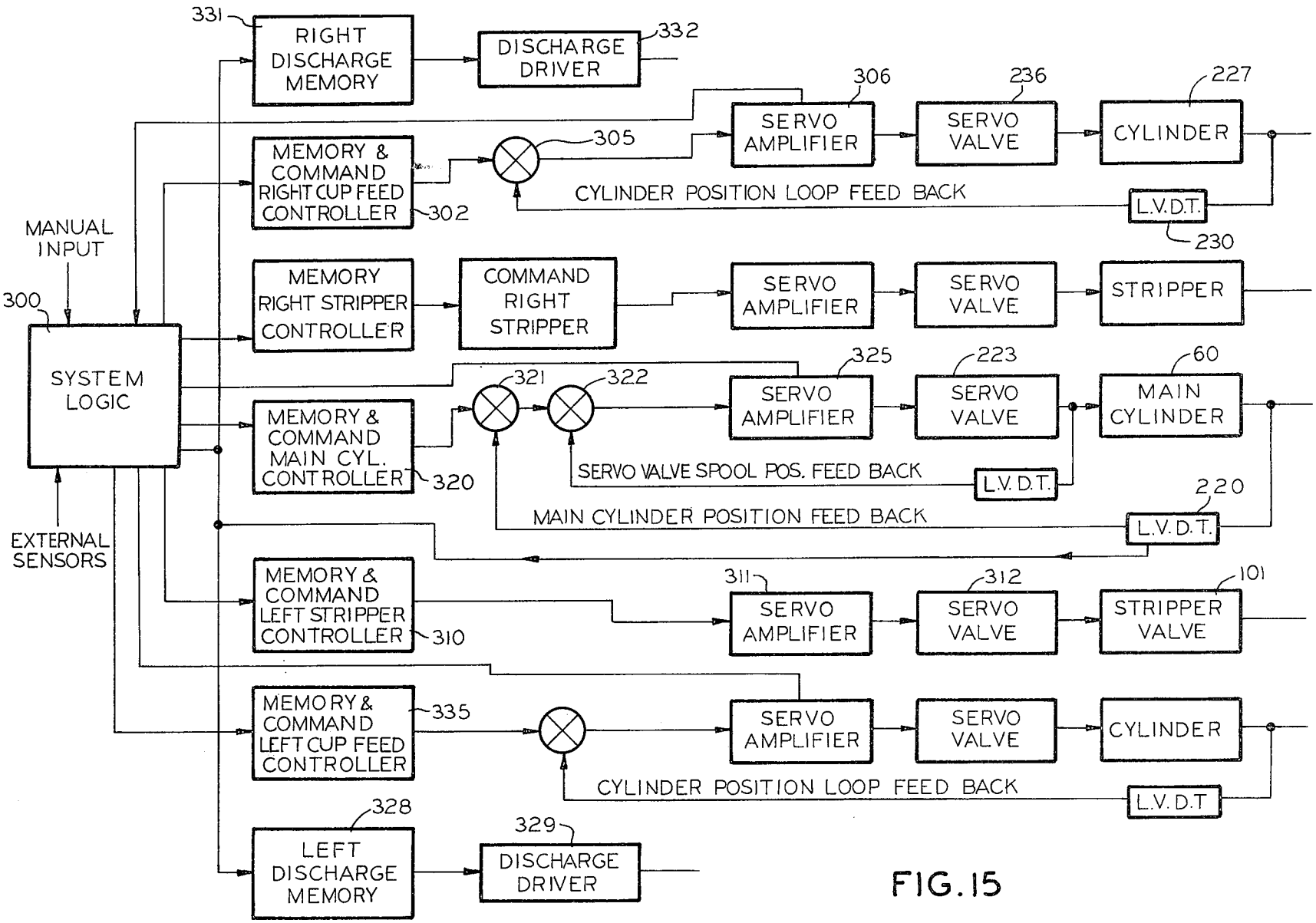
FIG. 15 is a block diagram of machine controls.

Essential functions characterizing the foregoing are diagrammed in FIG. 15. Information concerning machine functions is delivered to, analyzed by and acted on by a logic control. If information called for is lacking, either in digital or analog form, the logic control detects the unsatisfied condition: the punch is stopped and both cup feeders are stopped by positioning their operating valves in null position. Also, the shell delivery device 58 is stopped to enable the malfunction to be corrected.

As noted above, movement of the punch body 33 (and the cylinder rod 33A coupled thereto) FIG. 13, is monitored (followed) by a transducer. In FIG. 13, this transducer is identified by reference character 220 and consists of a linear variable differential transformer which comprises a set of coils, a primary and two secondaries, isolated within a sleeve 221 located in a fixed position inside the cylinder block 60, FIG. 13, and a core rod 222. The core rod 222 is constantly displaced with a punch body, as by securing the outer end of the core rod to a lug 223, in turn mounted on the coupling 33C which unites the punch body 33 to the cylinder rod 33A.

Displacement of the core 222 varies the voltage of the transducer, establishing a voltage analog of punch body position. The voltage analog is emitted by a conductor wire 220W and is delivered to an algebraic summing amplifier which in turn feeds punch position information back to the logic control as shown in FIG. 15. A sum of zero signifies the punch has attained the full stroke position and if the various events permissive of punch reversal are satisfied, the logic control delivers a corresponding command to a pilot servo valve 224, FIG. 7, which positions the spool of 4-way valve 66 for the main cylinder. The valve 66 and its servo valve 224 are (collectively) the 79 series of Moog Inc., 3-stage servo.

Figure 14:
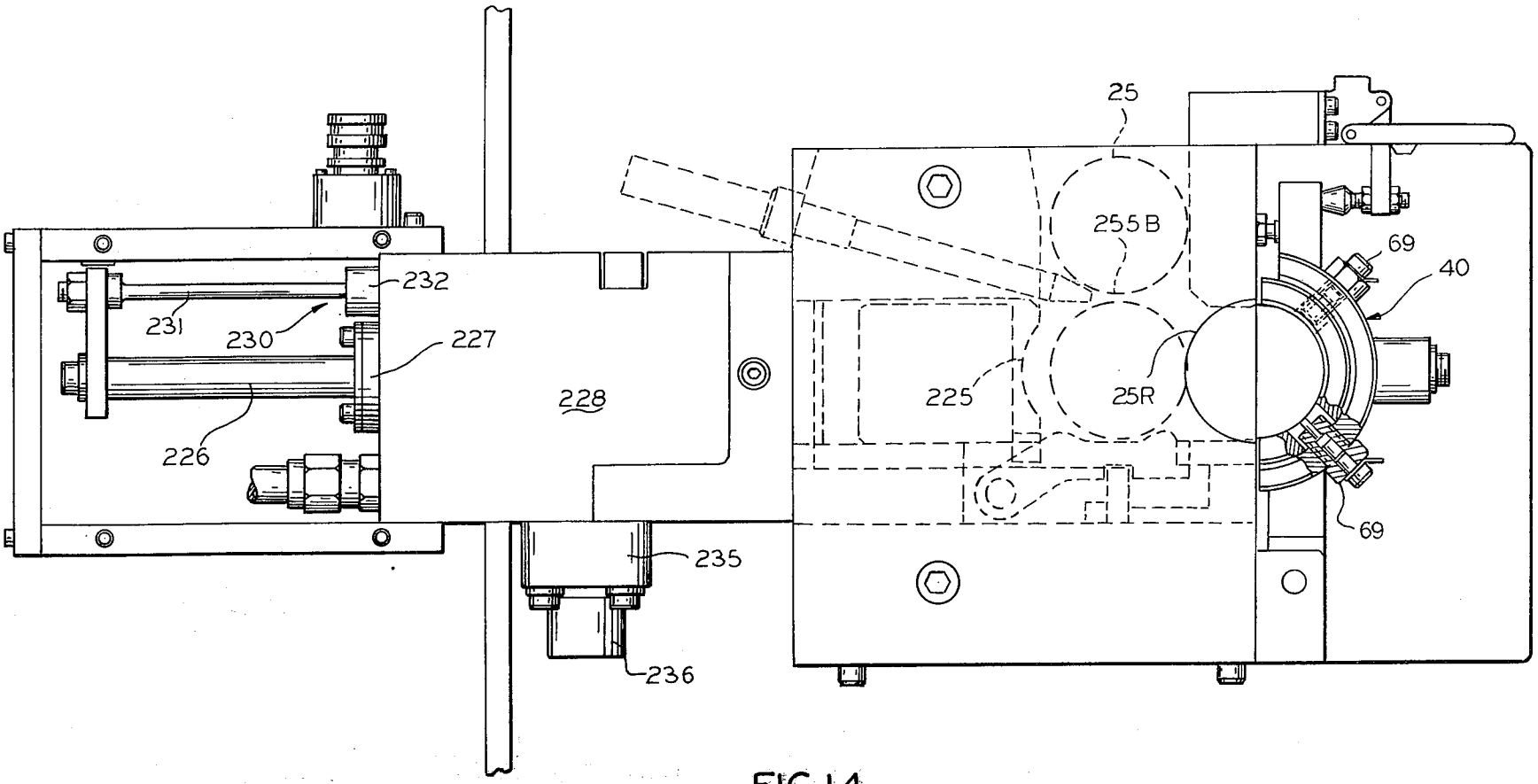
FIG. 14 is an elevation of the feed means for the cup blank.

Each cup feeder is of the form shown in FIG. 14, effective to advance a cup from a standby position 25SB to ready position 25R in contact with the proximity sensors 69 which, when actuated, signify the cup is on the axis or center line of the punch.

The cup (blank) to be drawn and ironed is moved to ready position by a plunger 225 secured to a cylinder rod 226 operated hydraulically in a cylinder 227 contained within a cylinder block 228.

A transducer 230 is afforded for tracking the cup feeder and is similar to the transducer 220 described above, including a core 231 secured to cylinder rod 226 and serving to vary the voltage of a linear variable differential transformer, the coils of which are contained in a protective sleeve 232 positioned in the cylinder block 228.

Hydraulic fluid is supplied to cylinder 227 by a 4-way valve 235. The spool of valve 235 is positioned by a pilot servo valve 236 in turn controlled by command signal derived from the logic control, as in the instance of the pilot servo valve 224 which controls the spool of the main cylinder valve 66. Any time a malfunction is indicated by a transducer in terms of failure to attain the programmed position, the servo valve is commanded by the logic control to locate the spool of valve 66 or valve 235 in center or null position interrupting delivery of fluid under pressure to the related cylinder rod. This same null position of valve 66 is timed to take place at the end of each stroke of the punch body, allowing the punch body to dwell (zero velocity) for a time sufficient to allow a cup to be fed at the other end of the punch body.

Thus it will be seen that the transducers for tracking cup feed position and punch body position each constitute sensing means constantly monitoring machine performance, which in conjunction with the summing amplifiers afford the capability of interrupting cylinder actuation (valve to null position) when positions do not conform to the logic control command.

Figure 20:
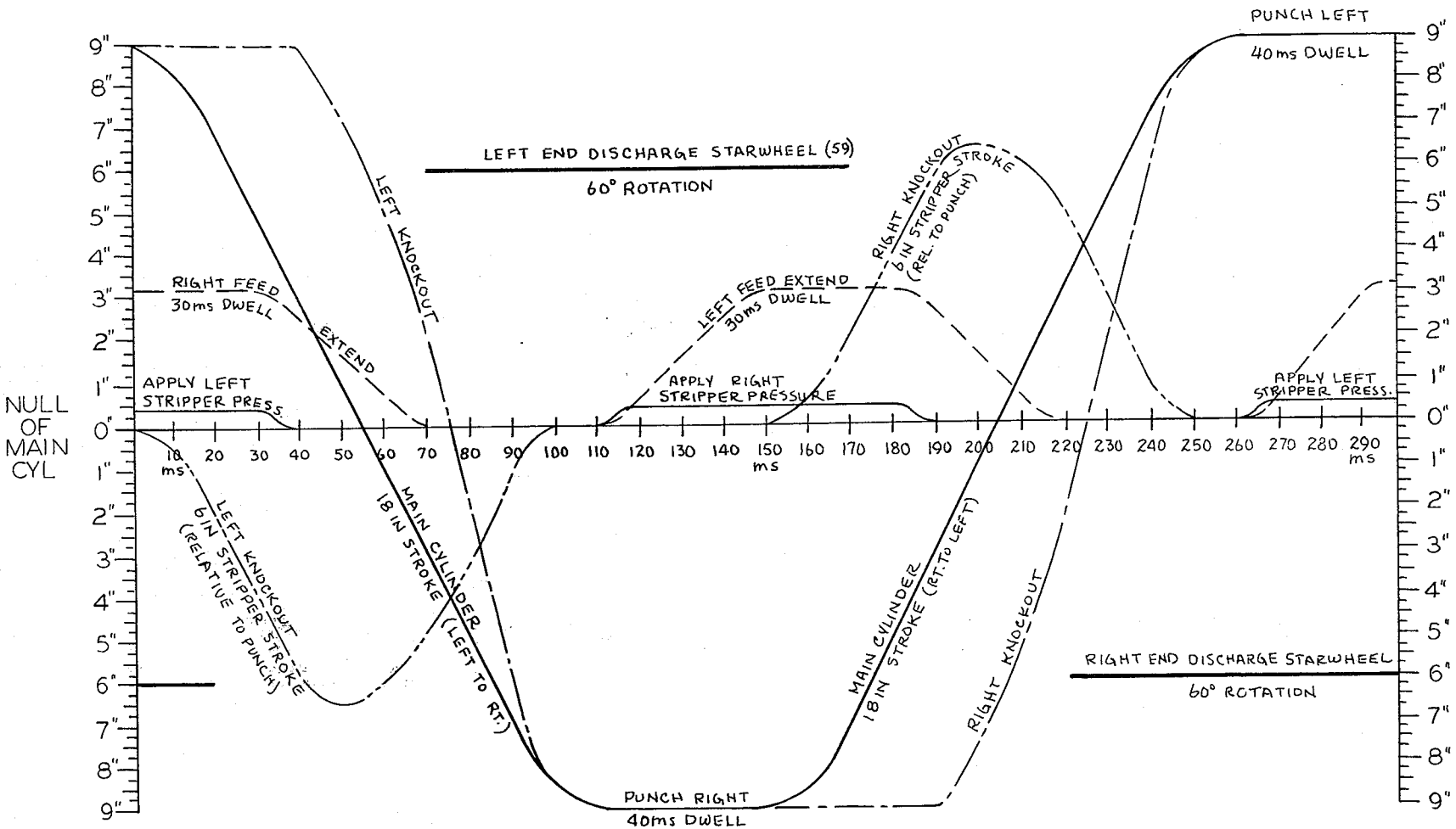
FIG. 20 is a timing chart.

As shown in the timing diagram, FIG. 20, the punch has an eighteen inch stroke in each direction with a slight dwell (no velocity) at each end of the stroke. The reason for the dwell, called for by the logic control program, will be explained. The fluid delivered to the main cylinder for operating the punch body is at constant pressure. The rate of delivering fluid under pressure is constant (constant volume) except for near the end of the punch body stroke when the pilot servo valve 224 is shifting the spool of the main valve to null (center) position, bringing the punch to a stop (followed by the dwell) as the ironed shell is pressed against the dimpling tool, and, by the same token the rate of fluid delivery is increasing at the beginning of the punch stroke as the punch is once more accelerated to peak velocity.

Energy Input

Under and in accordance with the present invention the input energy represented by the hydraulically actuated punch body in motion, when at peak velocity, is considerably less than the input energy of a flywheel driven punch body when at peak velocity, assuming identical punch body strokes and production rate. As a consequence, there is assurance that during cup deformation a temperature will not be attained inside the die stack resulting in so-called "reflow" of the material of which the can is composed. In more specific terms, one is assured of ample time to supply a flow of coolant (not shown) by practical means; consequently there will be no melting or plasticizing of the exterior of the cup undergoing deformation in the die stack, which both ruins the product and fouls the die stack. For example, the cup may be of low melting point metal or it may have a tin coating or an organic coating which will undergo excessive softening and will therefore melt if excessively worked in the die stack without ample time to extract heat. This can occur not infrequently with a mechanically operated punch at high velocity, especially if there should be an attempt to equal the production rate of the present machine.

Figure 16:
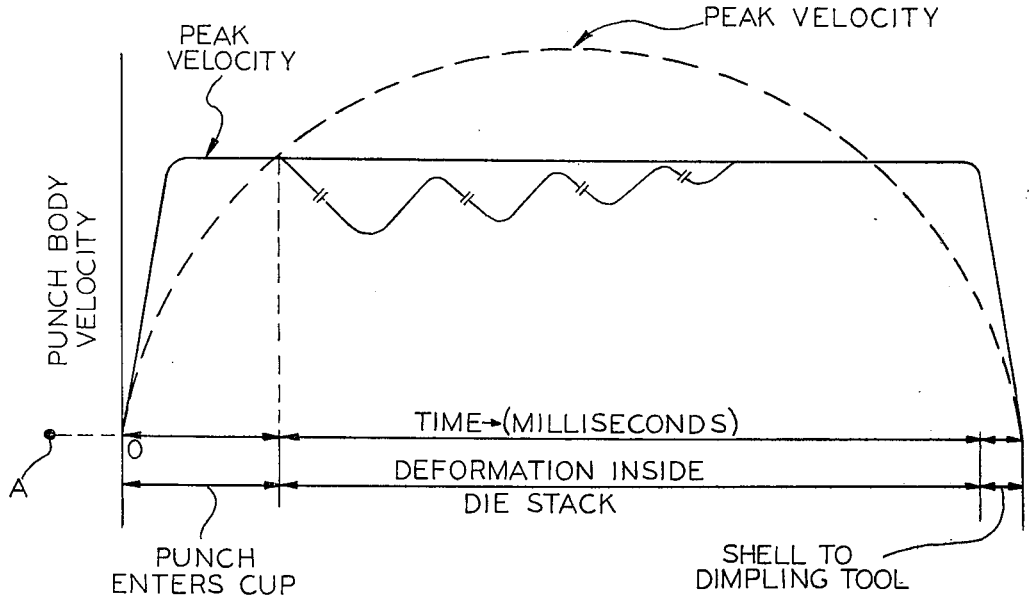
FIG. 16 is a diagram showing comparative relationships.

Aspects of the foregoing are depicted diagrammatically in FIG. 16. The dashed line is representative of the velocity profile of a crankshaft-driven punch operating on a flywheel principle, subscribing to simple harmonic motion. In any practical machine of that kind, the punch attains peak velocity inside the die stack, a velocity which characterizes peak power rate capable of deforming low melting point cup materials so fast that reflow temperature can be easily attained. In fact, there are prospective materials for shells of can configuration which simply will not withstand the energy rate input of a mechanically powered machine having a production rate comparable to the present machine. Another explanation for the disadvantage is that the rate of deformation attained at peak velocity of a mechanically powered (flywheel effect) machine is so fast during the critical part of the cycle that there is insufficient time for the heat product to escape from the shell, causing overheating which can also shorten the life of the die stack.

In further explanation, it will be noted that three significant stages of production are shown in FIG. 16, related to the punch stroke of the present machine which is eighteen inches. Approximately one-third of this travel is represented by the punch moving the completed shell (assume a shell of five and one-half inch length, untrimmed) out of the die stack and against the dimpling tool with room enough for proper discharge. Approximately one-half of the punch stroke takes place through the die stack. The remainder (about 3 inches) represents the amount of punch movement during the opening portion of the punch stroke. This remaining amount consists of the entry of the punch into the cup and movement of the cup into contact with the drawing die 41. In this connection, referring to FIG. 9, the punch sleeve 35E is shown at the threshold of entry into the cup positioner 40, that is, the end of the punch is spaced very slightly from the free edge of a cup in ready position. This is also the dwell position of the punch, at the "bottom" of the just completed stroke to the left, the shell on the left being ready for stripping. It is during the dwell period (see FIG. 16) when a new cup is fed to ready position, as noted.

The ability of the punch to dwell at the bottom of the forming stroke presents another contrast to a punch operated on the flywheel principle where, due to the feature of simple harmonic motion involved (a sine wave of which one-half is shown in FIG. 16) there is instantaneous reversal of the punch at bottom dead center. Since there is instantaneous reversal, it is impossible that the forward punch stroke of an uncompensated flywheel driven punch start from the position shown in FIG. 9 where the end of the punch, having just finished the previous stroke, is nearly coincident with the free edge of the cup next to be deformed. In other words, in the case of a punch which partakes of simple harmonic motion, the punch has to be further retracted by a distance (say to point A, FIG. 16) in order to allow sufficient time to feed a cup into ready position. Since the punch has to be retracted farther (at both ends of the stroke indeed) the production rate is diminished which can be recovered only by operating at a higher speed (to attain the same shell/minute production rate) but this would mean an even higher peak velocity inside the die stack, the velocity to be avoided as noted above.

The velocity curve for the uncompensated mechanical punch, dashed line, FIG. 16, is ideal. In the real circumstance the velocity of the punch repeatedly drops off and then recovers as the die elements are repeatedly encountered and cleared, both draw and iron.

The ideal velocity curve for the punch body under the present invention is shown by the solid smooth line in FIG. 16; the actual curve also repeatedly drops off and then recovers as the die elements are encountered and cleared, as shown by the hatched line in FIG. 16.

The point is that the hydraulic force applied to the piston assembly 31 for powering the punch body is varying according to the load on the punch in such a way as to maintain a substantially constant punch velocity through the die stack, fluctuating somewhat only because of the resistance of the spaced rings which deform the cup into a shell of the progressing length. The velocity is kept below that critical value where the horsepower developed would result in a reflow temperature. In fact, as shown in FIG. 16, the peak punch body velocity is attained outside the die stack, not inside.

THE SHORT SHELL DETECTOR

In the instance of thin-walled shells, a proximity detector, physically contacting the shell to determine correct length, is not always reliable and in addition requires considerable maintenance. What is more, physical contact can result in a damaged shell, necessitating shutdown.

The short shell detector embodied in the present machine operates by detecting metallurgical differences in materials based on changes in an electromagnetic field and emitting a corresponding signal. In one specific form, it includes an oscillator having an operating frequency which depends upon the inductance of a particular sensing coil. If one substance interdicts the field of the coil, the inductance will be of a particular value, but if another substance of markedly different magnetic properties interdicts the field the inductance will be of different value.

Figure 17:
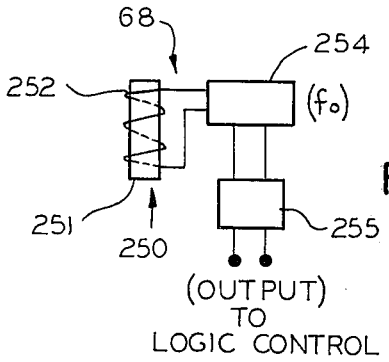
FIGS. 17, 18 and 19 are detail views of the short shell detector means.

Referring to FIG. 17, the short shell detector comprises an inductor 250, represented by a core 251 and a coil 252, that is connected into the frequency-determining circuit of an oscillator 254. A phase-locked-loop frequency comparator 255 is coupled to the oscillator 254.

The inductance of coil 252 will vary, depending upon whether there is merely an air gap beneath the coil, whether there is only the punch element 35E (tungsten carbide) adjacent the coil, or whether the steel shell 26 projects into the field space at the end of the coil.

In the null state, with neither a punch nor a shell in the inductance field, FIG. 17, the frequency of the oscillator 254 may be taken as a value $f_o$, significant of an air gap.

An event-set-point switch in the logic control is electronically triggered at the time when shell formation of correct length should have taken place. The sensing probe, the inductance 250, is located to sense whether a shell of correct length has been obtained; if this is indeed the case, FIG. 18, the variance in the inductance results in an oscillator frequency $f_1$, FIG. 18. The output from the phase-locked-loop, delivered to the logic control, signifies "no error".

Figure 19:
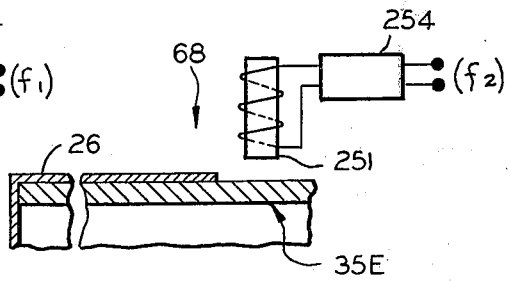

On the other hand, the inductance of the sensing coil 252 will be different if, at the time of event-set-point switching, only the material of the punch element interdicts the inductance field, resulting in a frequency $f_2$ emitted by the oscillator, FIG. 19. This frequency is detected by the internal comparator of the phase-locked-loop; the output characterizes an error. The logic control, informed of the error, signals the servo valves identified above, which thereupon set the main cylinder valve and the cup feeder valves to null position.

Figure 18:
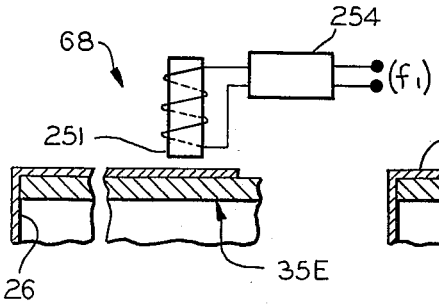

In the illustrated short shell detector, FIGS. 17–19, $f_2>f_o>f_1$, and the differences between the sensor frequencies can readily be made great enough for consistent and accurate detection in the comparator 255. It will be recognized that other frequency relations may obtain if the magnetic properties of the punch and shell are changed (e.g., an aluminum shell on a steel punch) or if the sensor is modified to constitute a capacitive sensing device instead of an inductive device.

Similar event-set-point switching in the logic control is employed for the various "no error" machine functions: cup feed rod fully extended; cup in position; punch body fully extended; shell being stripped and so on.

SEQUENCING: FIGS. 15 AND 20

Assuming the punch body starting from an at-rest position, fully extended to the left in an automatic mode of operation, and that all external functions are satisfied, such as adequate level of cup blanks, discharge system operable, trimmer operable and so on, the sequence of operation may be summarized in the following steps:

1. Feed Cup on the Right; Actuate Stripper on the Left

The system logic 300, FIG. 15, delivers a binary signal to a command signal conversion unit 302 for the right-hand cup positioner means. The conversion unit stores the signal, converts it to a voltage analog and delivers the analog signal as a right-hand cup feed command signal to an algebraic summing junction 305 of a servo amplifier 306 which in turn controls the servo valve 236 for the right-hand cup feed cylinder 227, FIG. 14, which is thereupon actuated.

Extension of the cylinder rod for the right-hand cup feed cylinder is tracked by its transducer 230 which delivers a feed back signal to the algebraic summing junction 305. This feedback information (voltage) is indicative of the extended position of the cup feed cylinder rod. Concurrently, the logic control delivers a signal to the left-hand stripper control unit 310 which in turn directs a voltage control signal to a servo amplifier 311 which services a servo valve 312 for the left hand stripper valve 101 (see FIG. 1).

2, 3. Check Extended Cup Feed, Cup in Position (Right) and Extend Punch to the Right When the servo amplifier 306 detects the feedback information has algebraically cancelled the command signal from unit 302, this information is sent to the logic control. In turn, the next event, originated through the logic control program, is a command signal from the main cylinder control unit 320 through two summing junctions 321 and 322, provided the external sensor 69 has detected a cup on the right located on the punch body center line. The command signal to extend the punch body to the right travels from the servo amplifier 325 to the servo valve 223, actuating the main cylinder 60.

4. Check Stripping on the Left

The system logic is programmed to check if a shell is being stripped on the left, after 3 inches of punch travel to the right. In this connection, it has already been mentioned that a proximity detector (not shown, but similar to the sensors 69) is located at each dimpling tool to determine if a shell is being held against the dimpling tool during punch retraction, such holding action being due to continued actuation of the valve as 101, FIG. 1, which services the left-hand stripper.

5. Retract Cup Feeder (Right) and Disable (Left) Stripper

After 5 inches of punch body movement to the right, the logic system calls for the right-hand cup feeder to be retracted, and the valve for actuating the left-hand stripper is to be located in null position. This programmed check, in terms of punch body movement, will depend upon the length of the shell being formed.

6. Signal Left Discharge to Index

After 12 inches of punch body movement to the right, the delivery mechanism on the left (see FIG. 9, unit 58) is actuated to deliver the completed shell to the trimmer, not shown. Again, the system logic sends a signal for the event to a left discharge memory unit 328 which controls a driver 329, FIG. 15, for the left-hand discharge turret.

7. Check Short Shell Detector, Right

The short shell detector 68, FIG. 9, like the detector 69 and the detector which signifies a shell being held against the dimpling tool, is one of the external sensors, FIG. 15. At a programmed point of punch body travel (after 16.5 inches of travel to the right) the system logic checks the short shell detector on the right to determine if the shell is of adequate length. If so, the logic control 300 (as in the instance of all other monitoring) continues the normal cycle sequence.

8. Detect Full Punch Extension, Right 18 inches of punch travel to the right should be indicated by a corresponding voltage emitted by the transducer 220, delivered both to the system logic and to the summing junction 321. Concurrently, the servo amplifier 325 should detect a null condition of voltage meaning that the transducer voltage has cancelled the command signal voltage. If so, amplifier 325 sends a null-condition-satisfied signal to the logic control.

It will be noted, FIG. 15, that the voltage signal emitted by transducer 220 is not only delivered to the summing junction 321 and the system logic but also to the left discharge memory unit 328 and the right discharge memory unit 331 for controlling the drivers which operate the discharge turrets.

9. Detect Punch at Null Condition

If the information from amplifier 325 signifies a punch fully extended to the right, event-set-point switching within the system logic unit 300 calls for the punch to be held in the null state for the dwell period, allowing sufficient time for cup feed to occur on the left. This requires a new command from unit 320 to set the spool of the servo valve 223 to null position, a condition which can be checked for compliance by a continued "null" signal returned to the logic system by amplifier 325.

10. Advance Left Cup Feed; Engage Right Stripper

On completion of steps 7 and 8, the logic control event-set-point switching delivers a signal to the memory and command unit 335 for the left cup feed control, FIG. 15. A cup on the left is fed to ready position. Performance now follows step No. 1 above but in the reverse sense, equally true for activation of the stripper on the right.

In light of the foregoing, steps 11 through 18 continue for the circumstance of forming a shell on the left end stripping on the right:

11. Check for cup feed mechanism extended and cup in position (left side);
12. Extend punch toward left side of machine;
13. At three inches of punch travel, check for can being properly stripped;
14. At five inches of punch travel, retract left cup feed and disengage right stripper;
15. At twelve inches of punch travel, signal right discharge to index;
16. At 16.5 inches of punch travel, examine shell on the left for proper length;
17. At eighteen inches of punch travel, detect punch full left; and
18. At eighteen inches of punch travel, detect punch at null condition.

In summary, concerning the control system of FIG. 15, and the timing chart of FIG. 20, the logic control 300, binary coded and embodying event-set-point switches of known form, is responsive both to the external sensors and the internal feedback for the LVDT monitors associated with the main cylinder and the two cup feed cylinders. Thus, the punch body continues to advance in one direction or the other, once commanded to do so. This advance will be interrupted, manifest in valve 66 being set to null position by an appropriate signal for the control means 300 in the event the control means 300 fails to detect a signal (see FIG. 19) from the sensor 68 indicative of a shell of correct length at the time the event of a shell of current length should have occurred. Similarly, travel of the punch body in the direction of a shell forming station is interrupted (again by setting valve 66 to null by an appropriate signal from the logic control) if there is failure by the logic control to receive a signal from the sensor 69 indicating the event of a cup to be deformed being on the axis of the advancing punch body; and the same mode of interruption prevails if the LVDT means 230 fails to cancel the signal commanding cup feed at the time when the cup feeder should be fully extended.

Valve 66, once opened in response to the command signal, is adjusted by its servo valve to comply with the command signal, which is to say the feedback signal (signifying punch body position) is compared to the command signal at the summing junction (see FIG. 15) and any unacceptable lag or lead is corrected by the servo valve adjusting the orifice of valve 66.

When the LVDT sensing means 230 indicates the event that the punch has attained a home position, pressing the bottom of the shell against the dome tooling, FIG. 11, a null signal is emitted at the summing junction, FIG. 15 and the logic control concurrently originates several commands: Valve 66 is located in null position and held there for the dwell period explained above; valve 101 is actuated to furnish fluid under pressure to chamber 131, FIG. 12, ported to the stripper piston 56 at one end of the machine; and, at the other end of the machine, cup feed is instituted and is completed during the dwell period. Each valve 101, FIG. 1, is a standard 4-way valve in which the spool is pilot-operated.

After the dwell period sequence, valve 66 is sequenced to reverse the punch body. Such sequencing of course does not take place, and valve 66 is set to null position, preventing LVDT (220) feedback to the logic control, and therefore all future sequencing, at any time performance requirements are not met: failure to attain a shell of correct length during punch travel; failure of the punch to attain home position; valve 66 not set in null position for the dwell period; failure to feed a cup at the opposite end of the machine and so on. As long as the machine performance sequence is satisfied, event-set-point switching continues, and the valves as 66 and 235 are repeatedly sequenced for continuous operation, left and right.

We claim:

1. In a machine of the kind described having punch and die means cooperating at a forming station to develop the shell of a can from a blank:

a reciprocal punch body of tube form and a stripper inside the punch body together presenting independent, supplementary punch elements engageable with the blank during a forward stroke of the punch body to move the blank through the die means incidental to forming the shell;

means to advance the punch body and stripper through a forward stroke predetermined as sufficient to complete formation of the shell and to retract the punch body through its reverse stroke after the shell is formed;

the punch element of the stripper being supported by a rod having a piston located within a stripper cylinder presented by the punch body;

a bushing for supporting and guiding the punch body during its forward and reverse strokes, said bushing having a chamber for receiving fluid under pressure;

a port in the punch body opening into said cylinder, and said port being continuously communicated to said chamber after the punch body has attained a predetermined point of forward travel, short of completion of the forward stroke;

means to deliver fluid under pressure to said chamber after the punch has completed its forward stroke and thereafter to reverse the punch body which retracts while the stripper remains engaged with the bottom of the shell thereby to strip the shell from the punch body;

and means to retract the stripper after the shell has been stripped.

2. A machine according to claim 1 in which the means to retract the stripper comprises a spring compressed by the punch body during its reverse stroke, the spring expanding to retract the stripper when the port clears the chamber in the bushing on the reverse stroke of the punch body.

3. A machine according to claim 2 including means to supply air under pressure through the stripper to impinge on the inside of the shell during stripping.

4. A machine according to claim 3 including means to apply air under pressure to the stripper piston to aid the spring in retracting the stripper.

5. A machine according to claim 1 including means to discriminate between the metallurgy of the shell and the punch to detect a short shell and to interrupt travel of the punch if there is a short shell.

6. A machine according to claim 1 in which the punch is double acting and in which there is a forming station at each end of the punch, the punch body having a medially positioned ram head located inside a cylinder block;

valve means alternately to supply operating fluid to opposite sides of the ram head;

means to detect formation of a short shell at each station by distinguishing between the metallurgy of the punch and the shell;

and control means to prevent movement of the punch body if there is a short shell at either station or if a blank is not aligned at the other station.

7. A machine according to claim 1 in which the punch is double acting and in which there is a forming station at each end of the punch, the punch body having a medially positioned ram head located inside a cylinder block;

valve means alternately to supply operating fluid to opposite sides of the ram head;

means to detect formation of a short shell at each station by distinguishing between the metallurgy of the punch and the shell;

means at each forming station to feed a blank from stand-by position to ready position aligned on the center line of the punch;

means at each forming station to detect a blank properly aligned in ready position;

and control means to prevent movement of the punch body if there is a short shell at either station or if a blank is not aligned at each station.

8. In a machine of the kind described having punch and die means cooperating at a forming station to develop a can shell from a blank:

a concentrically related punch body and shell stripper assembly coupled one to another both for unitary forward movement into and through the die forming station to form a shell from the blank and for reverse movement of the punch body independently of the stripper held stationary after the shell is formed, the stripper in its stationary state stripping the shell from the retracting punch body;

said stripper having a piston disposed in a cylinder presented by the punch body;

a fixed bushing for supporting and guiding said assembly and having a chamber for receiving and transmitting fluid under pressure to said cylinder to hold the stripper stationary at the end of forward punch travel;

a transfer port in the punch body communicating with said cylinder and so located as to traverse said bushing chamber over a path of predetermined extent during reversal of the punch body, whereby fluid under pressure in said bushing chamber may be communicated to said stripper cylinder at the end of forward punch travel and allowed to prevail until said port clears the bushing chamber to depressurize the latter during reversal of the punch body;

and means to retract the stripper after said punch has so cleared the bushing chamber.

9. A machine according to claim 8 in which the means to retract the stripper comprises a spring compressed during retraction of the punch body and a body of compressed air inside the punch body, the compressed spring and body of compressed air both expanding against the stripper piston when the bushing chamber is depressurized as said port clears the bushing chamber during reversal of the punch body.

10. A machine according to claim 8 including means to supply air under pressure through the stripper to impinge on the inside of the can during stripping.

11. A machine according to claim 8 in which the stripper includes a punch element supported by a rod fastened to said piston, and said rod being hollow to serve as a conduit for air used to strip the shell.

12. A machine according to claim 8 including means to discriminate between the metallurgy of the shell and the punch to detect a short shell and to interrupt travel of the punch if there is a short shell.

13. A machine according to claim 8 in which the length of the bushing chamber approximates the length of the shell.

14. A method of controlling a reciprocal punch body and stripper housed therein which cooperate with a die means to form a can shell of predetermined length from a blank, while moving the punch and stripper forward by fluid under pressure, comprising the steps of:

coupling the punch and stripper for movement in unison from a start position through a forward stroke in one direction to form the shell in the die means;

communicating the stripper by means of a port in the punch body to a chamber for transmitting stripper operating fluid to the stripper at the forwardmost position of the punch and stripper and thereupon pressurizing said chamber;

retracting the punch body independently of the stripper after attaining the forwardmost position while concurrently pressurizing said chamber and continuing said porting whereby the stripper remains stationary and strips the shell from the punch body as the punch body retracts;

discontinuing said porting after the shell has been stripped while continuing to retract the punch body;

and restoring the stripper to its start position after said porting is discontinued.

15. A method according to claim 14 including the steps of using a monitoring means to monitor forward punch body travel and supplying fluid under pressure to said chamber when the monitoring means determines the punch body has attained its forwardmost position.

16. A method according to claim 15 including the step of sensing for formation of a shell of pre-determined length and preventing operation of the punch body if said predetermined length is not attained.

17. A method according to claim 16 including the steps of sensing that a blank is located on the center line of the punch body and preventing forward movement of the punch body if the blank is not so located.

18. A method according to claim 14 including the steps of storing energy for restoring the stripper as an incident to retracting the punch body and releasing the energy to restore the stripper coincident with discontinuing said porting.

19. A method according to claim 17 in which the steps are repeated in the opposite direction without interruption of punch body reverse movement.

20. A method according to claim 19 including the steps of storing energy for restoring the stripper as an incident to retracting the punch and releasing the energy to restore the stripper coincident with discontinuing said porting.

21. A method of controlling a reciprocal punch body and stripper housed therein which cooperate with a die means to form a can shell of predetermined length from a blank, while moving the punch and stripper forward by fluid under pressure, comprising the steps of:

coupling the punch and stripper for movement in unison from a start position through a forward stroke in one direction to form the shell in the die means;

communicating the stripper by means of a port in the punch body to a chamber for transmitting stripper operating fluid to the stripper at the forwardmost position of the punch and stripper and thereupon pressurizing said chamber;

supplying air under pressure to the inside of the shell being stripped through a passage in the stripper by communicating a port in the stripper passage to a chamber containing air under pressure and continuing said air porting during a portion of punch body retraction;

retracting the punch body independently of the stripper after attaining the forwardmost position while concurrently pressurizing said chamber and continuing said porting whereby the stripper remains stationary and strips the shell from the punch body as the punch body retracts;

discontinuing both forms of porting after the shell has been stripped while continuing to retract the punch body;

and restoring the stripper to its start position after said porting is discontinued.

22. A method according to claim 21 including the steps of using a monitoring means to monitor forward punch body travel and supplying fluid under pressure to said chamber when the monitoring means determines the punch body has attained its forwardmost position.

23. A method according to claim 12 including the step of sensing for formation of a shell of predetermined length and preventing operation of the punch if said predetermined length is not attained.

24. A method according to claim 23 including the steps of sensing that a blank is located on the center line of the punch body and preventing forward movement of the punch body if the blank is not so located.

25. A method according to claim 22 including the steps of storing energy for restoring the stripper as an incident to retracting the punch body and releasing the energy to restore the stripper coincident with discontinuing said porting.

26. A method according to claim 25 in which the steps are repeated in the opposite direction without interruption of punch body reverse movement.

27. A method according to claim 21 including the steps of storing energy for restoring the stripper as an incident to retracting the punch and releasing the energy to restore the stripper coincident with discontinuing both forms of porting.

28. A combined fluid operated, reciprocal punch and stripper apparatus for producing a shell from a blank in cooperation with die means, the punch and stripper being so coupled as to move in unison during a forward stroke to produce the shell while enabling the punch to be retracted independently of the stripper and comprising:

a punch body of tubular form encompassing a stripper operating rod, said punch body having a ram operable by fluid under pressure to reciprocate the punch body;

the stripper rod having a piston and the punch body affording a cylinder for the piston;

a dash pot plunger attached to the piston but spaced rearward therefrom and the punch body presenting a dash pot chamber encompassing and defining a home position for said plunger, said chamber communicating with said cylinder;

said stripper rod having an element thereon engageable with the bottom of the shell to strip the shell when the punch body is retracted relative to the stripper;

means to supply fluid under pressure simultaneously to the punch ram, to retract the punch, and to the stripper piston to hold the stripper stationary against the shell;

and spring means to restore the stripper after the shell is stripped, said plunger entering said dash pot chamber during restoration of the stripper thereby to ease the stripper into home position.

29. Apparatus according to claim 28 in which the stripper rod is provided with a passage enabling air under pressure to be applied to the interior of the shell being stripped;

said punch body being provided with a chamber for air isolated from the stripper passage; and a port on the stripper rod communicating with said passage and in position to be communicated to said air chamber in a self-valving relation by the punch body being retracted relative thereto.

30. Apparatus according to claim 29 in which said air chamber is presented by a sleeve on the punch body having a length corresponding to the length of the shell and in which an end of the sleeve closes said port when the punch body is retracted from the shell.

31. Apparatus according to claim 28 in which the stripper rod is provided with a passage enabling air under pressure to be applied to the interior of the shell during stripping;

said punch body being provided with an air chamber isolated from said passage, said chamber being confined between a pair of spaced end rings having a seal fit about the stripper rod circumference;

and a port in the stripper rod communicating with said passage in position to be normally closed with respect to said air chamber by one end ring during the forward stroke of the punch body, disclosed by said one end ring at the commencement of punch body retraction and closed by said one end ring after said air chamber has traversed the port during punch body retraction.

32. Apparatus according to claim 28 in which the spring is compressed during punch retraction.

33. Apparatus according to claim 31 in which the air chamber is presented by a sleeve separably secured to the punch body.

34. Apparatus according to claim 31 having a bushing in a fixed position for supporting the punch body;

a supply chamber in the bushing for fluid to be supplied under pressure to the stripper piston;

and a port in the punch body communicating with said supply chamber;

said port being aligned with said chamber but spaced longitudinally therefrom to communicate with the chamber only after the punch body has started its forward stroke.

35. Apparatus according to claim 34 in which the length of the supply chamber in the bushing is at least the length of the shell.

36. Apparatus according to claim 35 in which said chamber in the bushing is presented by a sleeve surrounding the punch body.

37. A combined fluid operated, reciprocal punch and stripper apparatus for producing a shell from a blank in cooperation with die means during a forward stroke of the punch and comprising:

a punch body of tubular form encompassing a stripper operating rod;

said stripper rod having a piston and the punch body affording a cylinder for the piston in home position;

said stripper rod having an element thereon engageable with the bottom of the shell at the end of said forward stroke to strip the shell when the punch body is reversed relative to the stripper;

means to supply fluid under pressure simultaneously to the punch ram, to retract the punch at the end of its forward stroke, and to the stripper piston to hold the stripper stationary against the bottom of the shell at such time;

spring means to reverse the stripper at an accelerated rate compared to the reversal of the punch after the shell is stripped;

and means on the punch body to decelerate the stripper as it approaches home position.

38. Apparatus according to claim 37 in which the stripper rod is provided with a passage enabling air under pressure to be applied to the interior of the shell being stripped;

said punch body being provided with a chamber for air isolated from the stripper passage; and a port on the stripper rod communicating with said passage and in position to be communicated to said air chamber in a self-valving relation by the punch body retracted relative thereto.

39. Apparatus according to claim 38 in which said air chamber is presented by a sleeve on the punch body having a length approximating the length of the shell and in which an end of the sleeve closes said port when the punch body is retracted from the shell.

40. Apparatus according to claim 37 in which the stripper rod is provided with a passage enabling air under pressure to be applied to the interior of the shell during stripping;

said punch body being provided with an air chamber isolated from said passage, said chamber being confined between a pair of spaced end rings having a seal fit about the stripper rod circumference;

and a port in the stripper rod communicating with said passage in position to be normally closed with respect to said air chamber by one end ring during the forward stroke of the punch body, disclosed by said one end ring at the commencement of punch body retraction and closed again by said ring after said air chamber has traversed the port during punch body retraction.

41. Apparatus according to claim 40 in which the air chamber is presented by a sleeve separably secured to the punch body, said air chamber having a length approximating the length of the shell.

42. Apparatus according to claim 40 having a bushing in a fixed position for supporting the punch body;

a supply chamber in the bushing for fluid to be supplied under pressure to the stripper piston;

and a port in the punch body communicating with said supply chamber;

said punch body port being aligned longitudinally with said chamber but spaced longitudinally therefrom to communicate with the chamber only after the punch body has started its forward stroke.

43. Apparatus according to claim 42 in which the supply chamber in the bushing is of a length approximating the length of the shell.

44. Apparatus according to claim 43 in which said chamber in the bushing is presented by a sleeve surrounding the punch body.

45. A horizontal double-acting fluid operated punch and stripper apparatus having a forward and reverse stroke for producing a can shell from a blank during each stroke, respectively by forcing each blank through die means at a pair of opposed shell forming stations, said apparatus including a centrally positioned cylinder block encompassing a reciprocal punch ram, a control valve for delivering operating fluid under pressure sequentially to opposed sides of the ram incidental to imparting said forward and reverse strokes, the construction of said apparatus being substantially identical outward from opposite sides of the ram, and comprising in respect of identity:

an elongated punch body extended outward of the ram;

means to advance a blank from stand-by position to ready position on the center line of the punch body and the die means;

a stripper rod inside the punch body, said stripper rod being equipped with a piston communicating with a cylinder therefor presented by the punch body;

a punch element on the end of the punch body opposite the ram and a supplemental punch element on the corresponding end of the stripper rod;

a bushing support presenting a bearing for guiding and supporting the punch body;

said bushing support being provided with a chamber for supplying fluid under pressure to said piston at the end of the forward stroke;

and a port in said punch body communicating with said cylinder and in position to traverse said chamber to valve the cylinder to the chamber during the reverse stroke of the punch body.

46. Apparatus according to claim 45 including means to sense the condition of a blank being on said center line, means to sense the condition of a shell formed of the proper length, means to monitor the condition of the blank feed means being advanced, and control means to stop sequencing of the valve if any one of said conditions is not met.

47. Apparatus according to claim 46 in which said punch body presents a chamber for supplying air under pressure to a passage inside the stripper rod, said passage opening into the supplemental punch element incidental to delivering air to the inside of the shell being stripped, a port on the stripper rod communicating with said passage, and valve means at one end of said air chamber for valving said port during the reverse stroke of the punch body.

48. Apparatus according to claim 45 in which the cylinder block is supported only at its sides, substantially at the geometrical center, for symmetrical thermal expansion and contraction along the center line of the punch body.

49. Apparatus according to claim 45 in which the punch elements are detachably mounted respectively on the punch body and the stripper rod.

50. Apparatus according to claim 47 in which the chamber in the bushing support and the chamber presented by the punch body are replaceable sleeves, each of the chambers corresponding in length to the length of the shell.

51. A machine for producing elongated shells of can dimension from blanks fed alternately to two spaced shell forming stations, and comprising:

die means arranged on a common horizontal axis at a pair of spaced die stacks which identify said stations;

feed means for feeding the blanks to ready position on said axis at each station;

a horizontal double-acting punch body arranged on said axis between the die stacks;

force applying means for moving the punch body in opposite directions through the respective die means; and feedback means monitoring punch body position and constantly adjusting the force applying means to establish substantially constant velocity of the punch body moving through the respective die means.

52. A machine according to claim 51 in which the force applying means imparts peak velocity to the punch body outside the die stack in each direction.

53. A machine according to claim 51 including means to impart a dwell period of zero velocity to the punch body for a predetermined time period at the end of each punch body stroke, the cup feed means being operable to feed a blank to ready position aligned on said axis at one station during the related dwell period of the punch body at the other station, and means operable during the dwell period to sense for a blank in alignment.

54. A machine according to claim 53 including transducer means constantly monitoring punch body travel.

55. A machine according to claim 51 including means to impart a dwell period of zero velocity to the punch body for a predetermined time period at the end of each punch body stroke, the blank feed means being operable to feed a blank to ready position aligned on said axis at one station during the related dwell period of the punch body at the other station, means operable during the dwell period to sense for blank alignment, and in which the force applying means imparts peak velocity to the punch body outside the die stack in each direction.

56. A machine according to claim 55 including transducer means constantly monitoring punch body travel.

57. A machine according to claim 51 having a fluid operated ram for driving the punch body, and valve means serviced by a pilot servo valve to both control and reverse delivery of fluid under pressure to the ram, said feedback means in turn controlling the servo valve.

58. A machine according to claim 57 in which the pilot servo valve is controlled by a transducer means constantly monitoring punch body travel.

59. A machine according to claim 58 in which the force applying means imparts peak velocity to the punch body outside the die stack in each direction.

60. A machine according to claim 59 in which the valve means is positioned to null position at each end of the punch body stroke to impart thereto a dwell of predetermined time period, the blank feed means being operable to feed a blank to one station in alignment with said axis during the related dwell period of the punch body at the other station, and sensing means operable during the dwell period to determine if a blank is in alignment.

61. A method of producing elongated shells of can dimensions from shorter blanks fed alternately to spaced die stacks arranged on a common horizontal axis at two shell forming stations and comprising:

feeding and centering blanks alternately on said axis at the two stations;

reciprocating a double ended, double acting punch body along said axis alternately to move the blanks through the die stacks to deform the blanks to shell form;

monitoring the position of the punch body during its travel; and constantly adjusting the position of the punch body to impart thereto substantially constant velocity as it traverses the die stack in each direction.

62. A method according to claim 61 including the step of imparting peak velocity to the punch body before it attains the die stack during each punch stroke.

63. A method according to claim 61 including the steps of allowing the punch body to dwell for a predetermined time period at the end of each stroke and feeding a blank of the opposite station during the dwell period.

64. A method according to claim 62 including the steps of allowing the punch body to dwell for a predetermined time period at the end of each stroke and feeding a blank to the opposite station during the dwell period.

65. In a machine which forms shells of can dimension from a blank by moving the blank through a deforming means including a die and in which the blank is of a material having given electromagnetic properties, a punch of material having different electromagnetic properties, on which the shell is supported on emerging from the deforming means, an electromagnetic field sensor positioned to create an electromagnetic field in an area corresponding to the free end of a shell of correct length, and means to discriminate between the field altered by the punch element alone, not supporting a shell of correct length, and the field altered by a shell of correct length on the punch.

66. A machine according to claim 65 in which the field sensor is an inductance connected in the frequency-determining circuit of an oscillator.

67. A machine according to claim 66 in which the discriminating means includes a phase locked loop comparator coupled to the oscillator, the comparator discriminating between an air-gap frequency ($f_o$), a frequency ($f_1$) where the shell is of correct length, and a frequency ($f_2$) where the shell is short.

68. A machine for producing elongated shells of can dimension from blanks fed alternately to two spaced shell forming stations, and comprising:

die means including a deforming die and at least one ironing ring arranged on a common horizontal axis at a pair of spaced die stacks;

feed means for feeding the blanks to ready position on said axis at each station;

a horizontal double-acting punch body arranged on said axis between the die stacks;

force applying means for moving the punch body in opposite directions through the die means;

means to impart a dwell period of zero velocity for a predetermined time to the punch body at the end of each punch stroke, the blank feed means being operable to feed a blank to one station in alignment with said axis during the related dwell period of the punch body at the other station; and sensing means operable during the dwell period to sense for a blank in alignment.

69. A machine according to claim 68 in which the force applying means imparts maximum velocity to the punch body outside the die stack in each direction.

70. A machine according to claim 68 in which the force applying means include a fluid operated ram supported on the punch body and valve means including a pilot servo valve to both control and reverse delivery of fluid under pressure to the ram.

71. A machine according to claim 70 in which the pilot servo valve is controlled by a transducer means constantly monitoring punch body travel.

72. A machine according to claim 71 in which the force applying means imparts maximum velocity to the punch body outside the die stack in each direction.

73. A machine according to claim 72 in which the valve means is positioned to null position at each end of the punch body stroke to impart thereto a dwell period.

74. A method of producing elongated shells of can dimension from blanks fed alternately to spaced die stacks arranged on a common horizontal axis at two shell forming stations and comprising:

feeding and centering blanks alternately on said axis at the two stations;

reciprocating a double-ended, double-acting punch body along said axis alternately to move the blanks through the die stacks to deform the blanks to shell form;

allowing the punch body to dwell for a predetermined time period at the end of each punch stroke and concurrently feeding a blank and sensing to determine if it is in centered position at one station during the dwell period of the punch body at the other station.

75. A method according to claim 74 including the step of imparting maximum velocity to the punch body before it attains the die stack during each punch stroke.

76. A machine for producing elongated shells from shorter blanks fed alternately to two spaced shell forming stations, and comprising:

die means including a deforming die arranged on a common horizontal axis at each station;

feed means for feeding the blanks to ready position on said axis at each station;

a horizontal double-acting punch body having a ram thereon and arranged on said axis between the stations;

means for sequentially applying a hydraulic force to opposite sides of the ram to move the punch body in opposite directions through the die means; and feedback means to monitor the position of the punch body and to vary the application of the hydraulic force to attain substantially constant velocity for the punch body moving through the die means.

77. A machine according to claim 76 in which the hydraulic force is regulated to impart maximum velocity to the punch body outside the die means in each direction.

78. A machine according to claim 76 including means to interrupt the hydraulic force to impart a dwell period of zero velocity to the punch body at the end of each punch body stroke, the said feed means being operable to feed a blank to one station during the related dwell period of the punch body at the other station, and including means operable during the dwell period to sense for a shell in ready position at said one station.

79. A machine according to claim 76 including means to interrupt the hydraulic force thereby imparting a dwell period of zero velocity to the punch body at the end of each punch body stroke, said feed means being operable to feed a blank to one station during the related dwell period of the punch body at the other station, and in which the hydraulic force is regulated to impart maximum velocity to the punch body before attaining the die means in each direction.

80. A machine according to claim 79 including transducer means constantly monitoring punch body travel.

81. A machine according to claim 80 including a pilot servo valve controlled by the transducer means to both control and reverse delivery of fluid under pressure to the ram.

82. A method of producing elongated shells from blanks fed alternately to spaced die stacks arranged on a common horizontal axis at two shell forming stations and comprising:

feeding and centering blanks alternately on said axis at the two stations;

reciprocating, by means of an applied hydraulic force, a double-ended, double-acting punch body along said axis alternately to move the blanks through the die stacks to deform the blanks to elongated shell form;

constantly comparing the position of the punch body to a programmed command position; and adjusting the application of the hydraulic force to correct the position of the punch body for compliance to the programmed command position.

83. A method according to claim 82 including the steps of allowing the punch body to dwell at the end of each stroke, feeding a blank at one station during the dwell period of the punch body at the other station, and determining, during the dwell period, if a blank is centered at said one station.

84. A method according to claim 82 including the step of imparting maximum velocity to the punch body before it attains each die stack.

85. A method according to claim 82 including the steps of allowing the punch body to dwell at the end of each stroke, imparting maximum velocity to the punch body before it attains each die stack, and feeding a blank at one station during the dwell period of the punch body at the other station.

86. In a machine of the kind described having punch and die means for forming the shell of a can from a blank:

a reciprocal double-acting punch body having a medially located ram inside a cylinder block;

a pair of spaced die stations at opposite ends of the body punch;

means to feed blanks to each station to be formed into shells respectively during the forward and reverse stroke of the punch body;

a floor-mounted bed for the machine;

a pair of vertically extending side posts supported by the bed;

said cylinder block being located between said posts, and trunnion means supported on said posts suspending the cylinder block substantially at its geometrical center.

87. A machine according to claim 86 in which the means suspending the cylinder block comprises a pair of center blocks having outwardly extending support arms supported by said posts and inwardly extended trunnion arms fitting cavities in the opposed sides of the cylinder blocks, side plates attached to the center blocks and end plates attached to the side plates, and said end plates having bottom surfaces freely reposing on the bed of the machine for equalized heat expansion of the side plates in opposite directions.

88. A machine according to claim 86 in which the means suspending the cylinder block comprises a pair of center blocks supported by said posts having trunnion projections thereon which suspend the cylinder block, side plates attached to the center blocks; and a pair of bushings supported by the side plates, said bushings supporting and guiding the punch body.

89. A machine according to claim 88 in which the side plates have end plates attached thereto, said end plates having bottom surfaces freely reposing on the bed of the machine for equalized heat expansion in opposite directions.

90. In a machine of the kind described having a punch for producing elongated shells from cup-shaped blanks fed alternately to die means located at two forming stations, said stations being aligned on a horizontal axis at opposite ends of a hydraulically operated double-acting punch-supporting body, and said punch-supporting body being centered on said axis for forward and reverse strokes to produce a shell from a blank during each such stroke;

a ram in a cylinder for driving the punch body and valve means for sequentially reversing the flow of hydraulic fluid to the ram to reciprocate the punch body;

extensible feed means for respectively feeding blanks alternately to a ready position on said axis at each forming station;

means to monitor both punch body travel and an extended position of each of said feed means;

and means to position said valve means in null position if the monitor means fail to detect the punch-supporting body is in full extended position at the end of a stroke or fail to detect a fully extended feed means.

91. A machine according to claim 90 including sensing means to determine if a blank has been centered on a said axis, said valve being set to null position if said sensing means fails to detect a blank so centered.

92. A machine according to claim 90 including sensing means to determine if a shell of correct length has been formed, said valve being set to null position if said sensing means fails to detect a blank so centered.

93. A machine according to claim 90 including sensing means to determine if a blank has been centered on said axis and sensing means to determine if a shell of correct length has been formed, said valve being set to null position if either sensing means determines a negative result.

94. In a machine of the kind described having punch and die means cooperating at a forming station to produce an elongated shell from a cup of shorter length:

a punch assembly afforded by a pair of complemental punch members, coupled one to another both for unitary forward movement into and through the die forming station to form a shell from the cup and for retracting movement of one of the members independently of the other member which is to be held stationary after the shell is formed, said other member in its stationary state stripping the shell while said one member is being retracted;

said other member having a piston thereon disposed in a cylinder presented by the punch assembly;

a fixed bushing for supporting and guiding said punch assembly and having a chamber for receiving and transmitting fluid under pressure to said cylinder to hold said other member stationary at the end of forward travel;

said punch assembly being provided with a transfer port communicating with said cylinder and so located as to traverse said bushing chamber over a path of predetermined extent during reverse movement of said one member whereby fluid under pressure in said bushing chamber may be communicated to said cylinder at the end of forward punch travel and allowed to prevail until said port clears the bushing chamber to depressurize the latter during reverse movement of said one member;

and means to retract the other member after said punch has so cleared the bushing chamber.

95. A machine according to claim 94 in which the means to retract said other member comprises a spring compressed during retraction of said one member.

96. A machine according to claim 94 including means to supply air under pressure through one of the members to impinge on the inside of the shell during stripping.

* * * * *